US011276960B2

(12) United States Patent
Colarusso

(10) Patent No.: US 11,276,960 B2
(45) Date of Patent: Mar. 15, 2022

(54) CONNECTOR WITH CONNECTOR POSITION ASSURANCE DEVICE

(71) Applicant: Molex, LLC, Lisle, IL (US)

(72) Inventor: Evan Colarusso, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/963,840

(22) PCT Filed: Jan. 29, 2019

(86) PCT No.: PCT/IB2019/050721
§ 371 (c)(1),
(2) Date: Jul. 22, 2020

(87) PCT Pub. No.: WO2019/150262
PCT Pub. Date: Aug. 8, 2019

(65) Prior Publication Data

US 2021/0057849 A1 Feb. 25, 2021

Related U.S. Application Data

(60) Provisional application No. 62/624,187, filed on Jan. 31, 2018.

(51) Int. Cl.
*H01R 13/627* (2006.01)
*H01R 13/506* (2006.01)
*H01R 13/641* (2006.01)

(52) U.S. Cl.
CPC ..... *H01R 13/6275* (2013.01); *H01R 13/506* (2013.01); *H01R 13/641* (2013.01)

(58) Field of Classification Search
CPC .. H01R 13/506; H01R 13/6275; H01R 13/64; H01R 13/641
USPC ..... 439/345, 347, 352
See application file for complete search history.

(56) References Cited

U.S. PATENT DOCUMENTS

| | | | | |
|---|---|---|---|---|
| 6,312,277 | B1 * | 11/2001 | Holub | H01R 13/6272 439/352 |
| 6,435,895 | B1 * | 8/2002 | Fink | H01R 13/6272 439/352 |
| 9,893,464 | B2 * | 2/2018 | Endo | H01R 13/641 |
| 10,276,980 | B2 | 4/2019 | Benichou et al. | |
| 2001/0027058 | A1 * | 10/2001 | Pederson | H01R 13/6272 439/595 |
| 2007/0020986 | A1 | 1/2007 | Fry et al. | |
| 2010/0233897 | A1 | 9/2010 | Seo et al. | |

(Continued)

FOREIGN PATENT DOCUMENTS

| | | | |
|---|---|---|---|
| WO | 2014/195747 | A1 | 12/2014 |
| WO | 2019/150262 | A1 | 8/2019 |

OTHER PUBLICATIONS

International search report and written opinion received for PCT application No. PCT/IB2019/050721, dated Jun. 5, 2019, 9 pages.

*Primary Examiner* — Oscar C Jimenez

(57) ABSTRACT

A connector system includes a header assembly, a receptacle and a connector position assurance (CPA) device. The CPA device has features which prevent the longitudinal movement of the CPA device relative to the receptacle until the receptacle is inserted into the header assembly. The CPA device includes a housing which has arms supported at both ends for increased strength. The CPA device, when assembled with the receptacle, provides a low-profile assembly.

20 Claims, 23 Drawing Sheets

(56) References Cited

U.S. PATENT DOCUMENTS

| | | | | |
|---|---|---|---|---|
| 2010/0255709 | A1* | 10/2010 | Tyler | H01R 13/6275 439/367 |
| 2016/0248188 | A1 | 8/2016 | Upson et al. | |
| 2017/0062982 | A1 | 3/2017 | Holub et al. | |
| 2020/0412055 | A1* | 12/2020 | Kurita | H01R 13/639 |

* cited by examiner

CONNECTOR WITH CONNECTOR POSITION ASSURANCE DEVICE

RELATED APPLICATIONS

This application is a national phase of International Application No. PCT/IB2019/050721, filed Jan. 29, 2019, which claims the domestic benefit of U.S. Provisional Application Ser. No. 62/624,187, filed on Jan. 31, 2018, the contents of each of which are incorporated herein by reference in their entireties.

TECHNICAL FIELD

The disclosure generally relates to connectors, and more particularly relates to a connector having a connector position assurance device.

DESCRIPTION OF RELATED ART

Electrical connectors are required to be securely connected to each other and are provided with locking features, such as latches, to lock the connectors to each other to form a connector assembly. It is known to provide the connector assembly with a connector position assurance device for movement between an initial, pre-locked position and a final locked position.

The connector position assurance device is secured in the initial, pre-locked position when the connectors are not fully assembled to one another. Upon complete mating of the connectors, the connector position assurance device can then be moved to the final locked position. Thus, the connector position assurance device ensures a proper connection between the connectors before the connector position assurance device can be moved to the final locked position. In the final locked position, the connector position assurance device also deters or prevents the mated connectors from being separated from one another. In some arrangements, the connector position assurance device can have a complicated and large structure. Certain individuals would appreciate improvements to a connector position assurance device by reducing its size and complexity.

BRIEF SUMMARY

The present disclosure generally relates to a connector system which includes a header assembly, a receptacle and a connector position assurance (CPA) device. The CPA device has features which prevent the longitudinal movement of the CPA device relative to the receptacle until the receptacle is inserted into the header assembly. The CPA device includes a housing which has arms supported at both ends for increased strength. The CPA device, when assembled with the receptacle, provides a low-profile assembly.

The present disclosure generally relates to an electrical connector having a connector position assurance device. The connector position assurance device is fitted to a receptacle and is operable between a first position and a second position. In the first position, the connector position assurance device and the receptacle are mated together. Upon mating the assembled connector position assurance device and receptacle with a header assembly, the connector position assurance device can be moved to the second position, assuring that the connector position assurance device, the receptacle and the header assembly are fully mated. The connector position assurance device is disposed between a surface of a locking latch of the receptacle and an internal dividing wall of the receptacle, thereby providing a low-profile arrangement.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1-17 illustrate an embodiment of the present invention and it is to be understood that the disclosed embodiment is merely exemplary of the invention, which may be embodied in various forms. Therefore, specific details disclosed herein are not to be interpreted as limiting, but merely as a basis for the claims and as a representative basis for teaching one skilled in the art to variously employ the present invention.

As illustrated in the accompanying figures, a connector system 20 includes a first connector or receptacle 22, a connector position assurance device 24 inserted within the receptacle 22, and a second connector or header assembly 26 into which the receptacle 22 and the attached connector position assurance device 24 is inserted. The connector position assurance device 24 is mated with the receptacle 22 and cannot be activated until the receptacle 22 is inserted into the header assembly 26. In some of the drawings, the connector system 20 is shown sideways from its normal orientation in use for ease in describing the components of the connector system 20 and the functioning of the components of the connector system 20.

Figure 1:
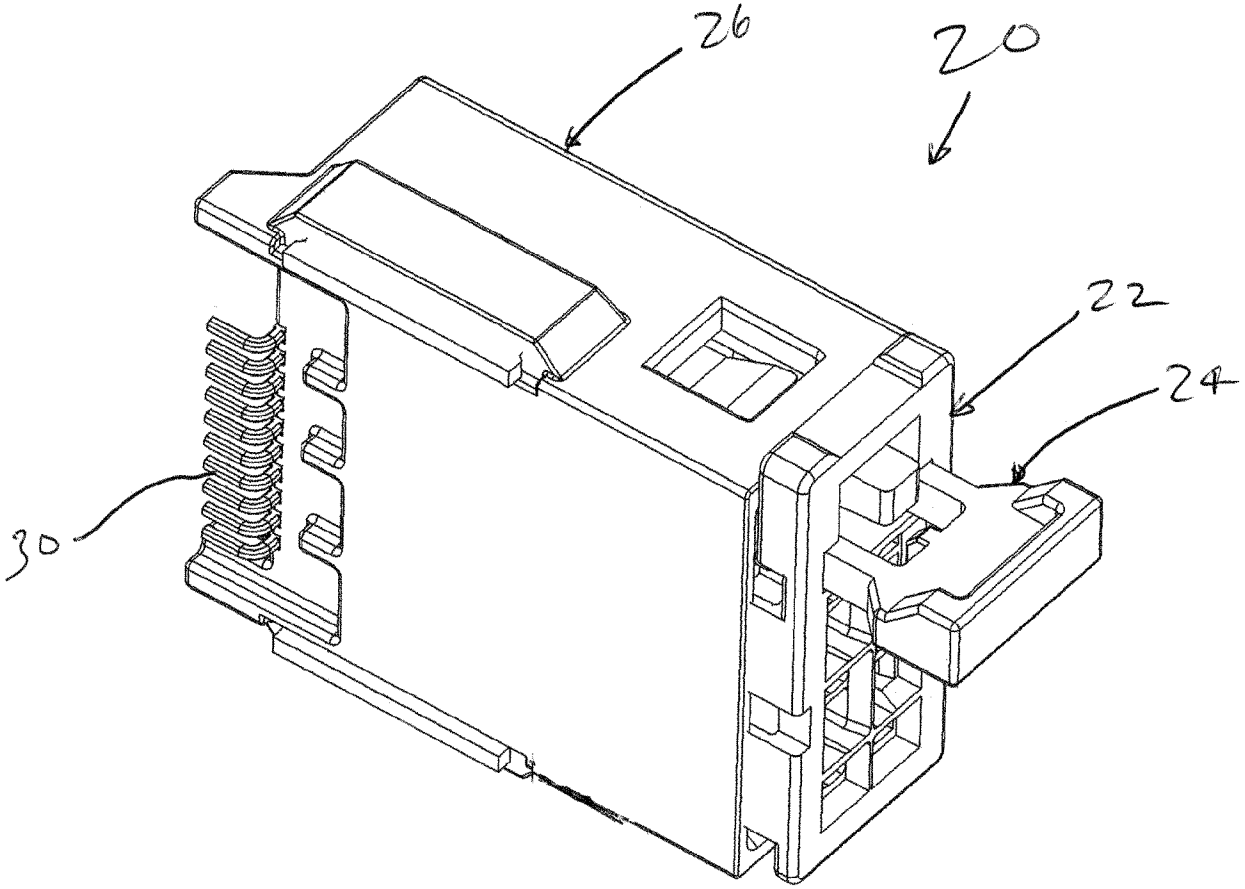
FIG. 1 is a bottom perspective view of a connector system, viewed from a rear end thereof, which incorporates the features of a first embodiment of the present disclosure.
Figure 2:
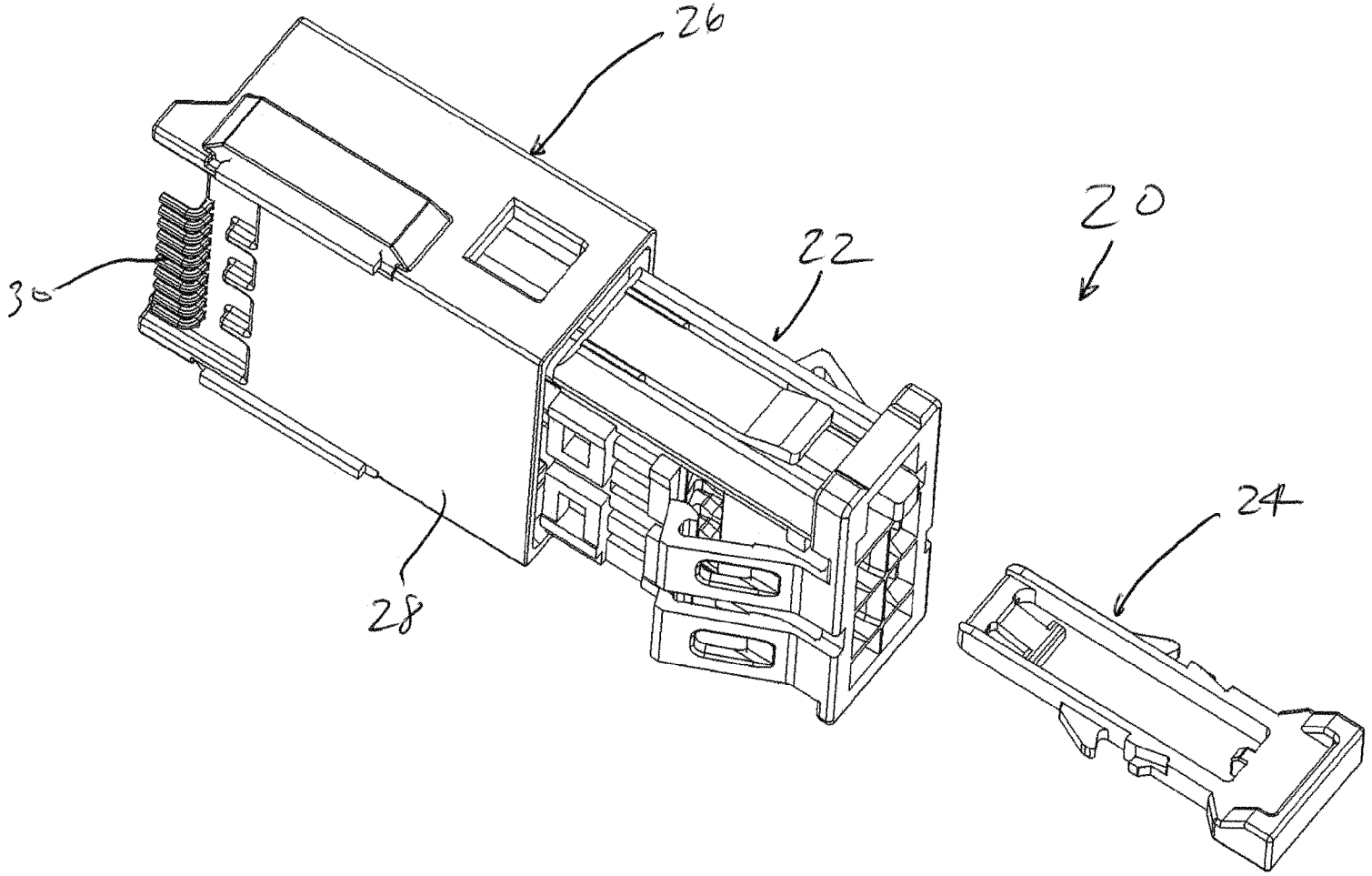
FIG. 2 is an exploded bottom perspective view of the connector system, viewed from a rear end thereof.
Figure 3:
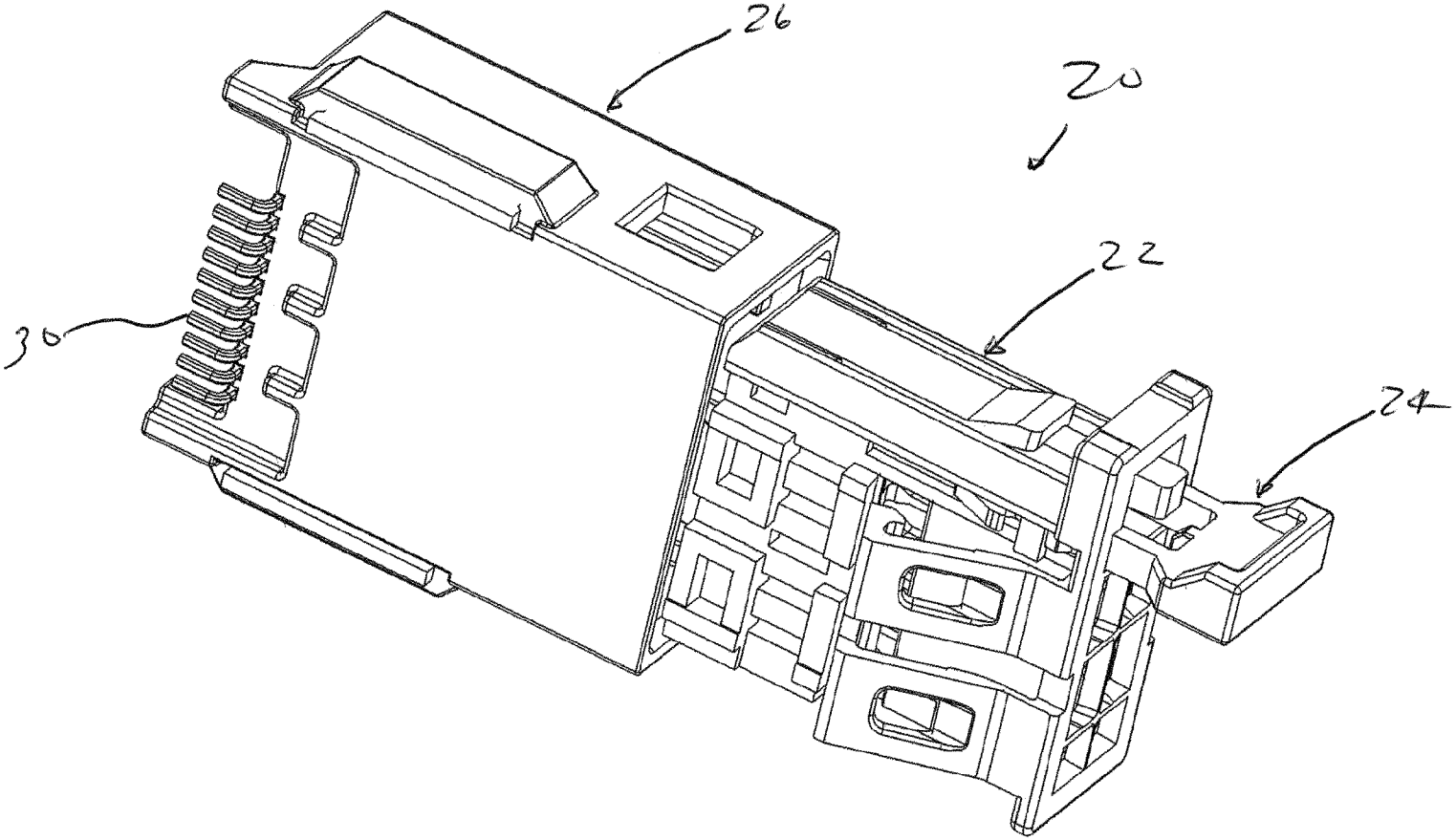
FIG. 3 is a partially assembled bottom perspective view of the connector system, viewed from a rear end thereof.
Figure 4:
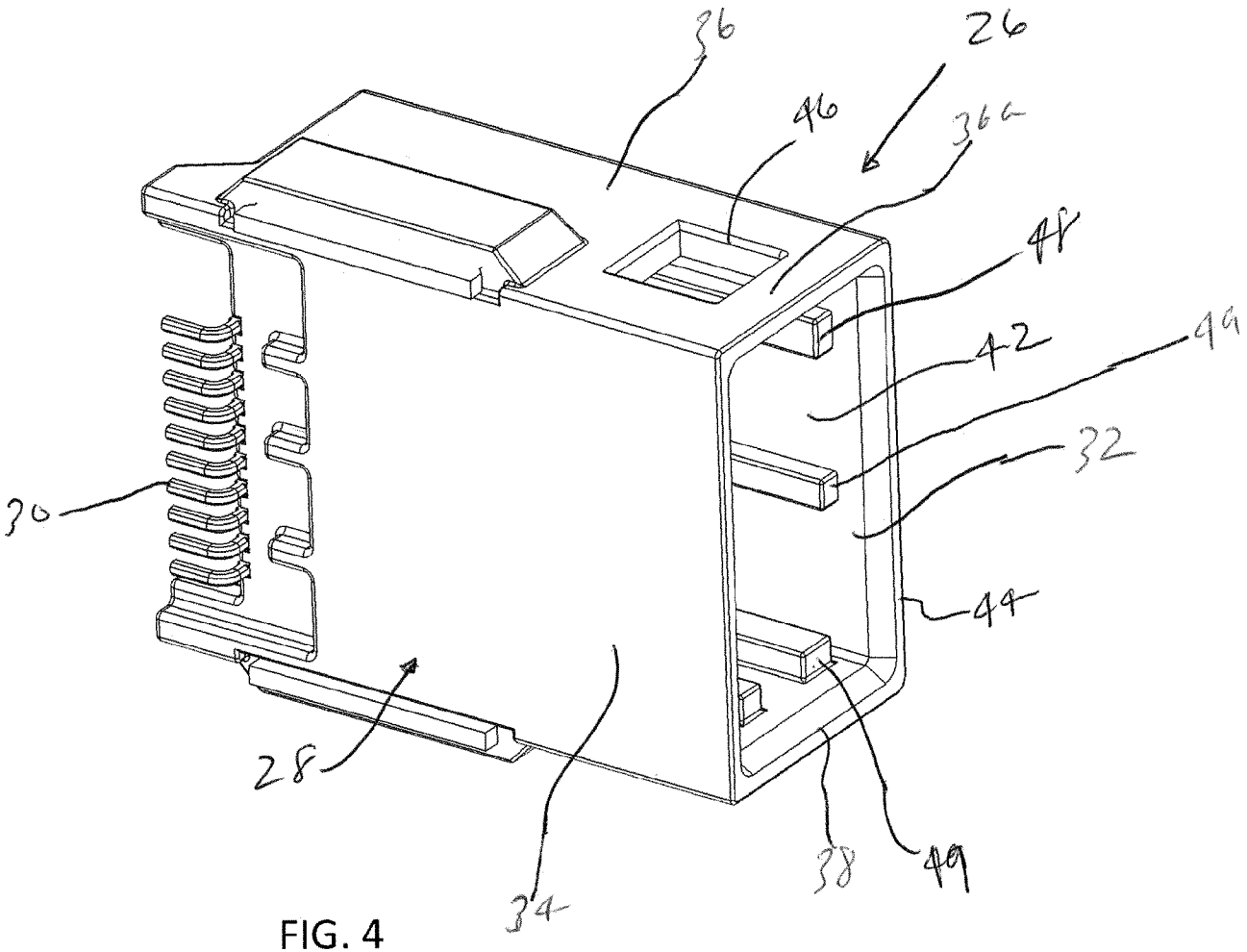
FIG. 4 is a bottom perspective view of a header assembly of the connector system, viewed from a rear end thereof.
Figure 5:
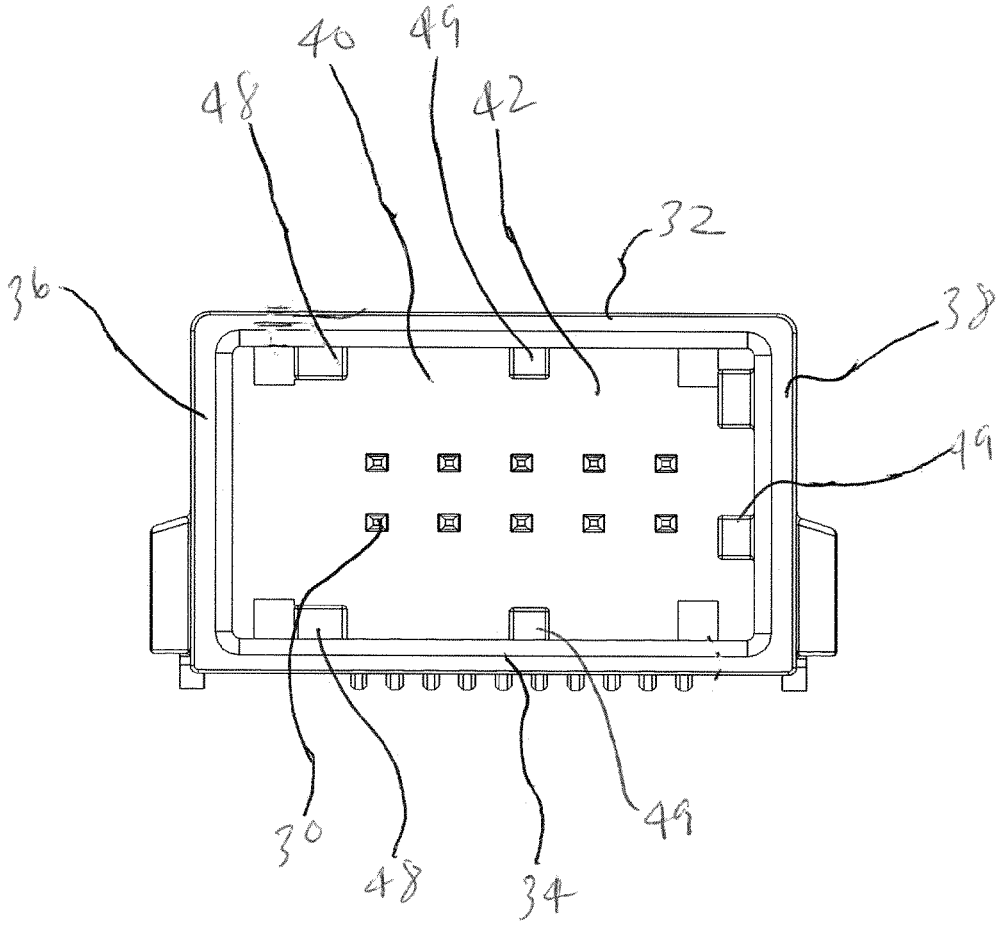
FIG. 5 is a rear plan view of the header assembly.
Figure 6:
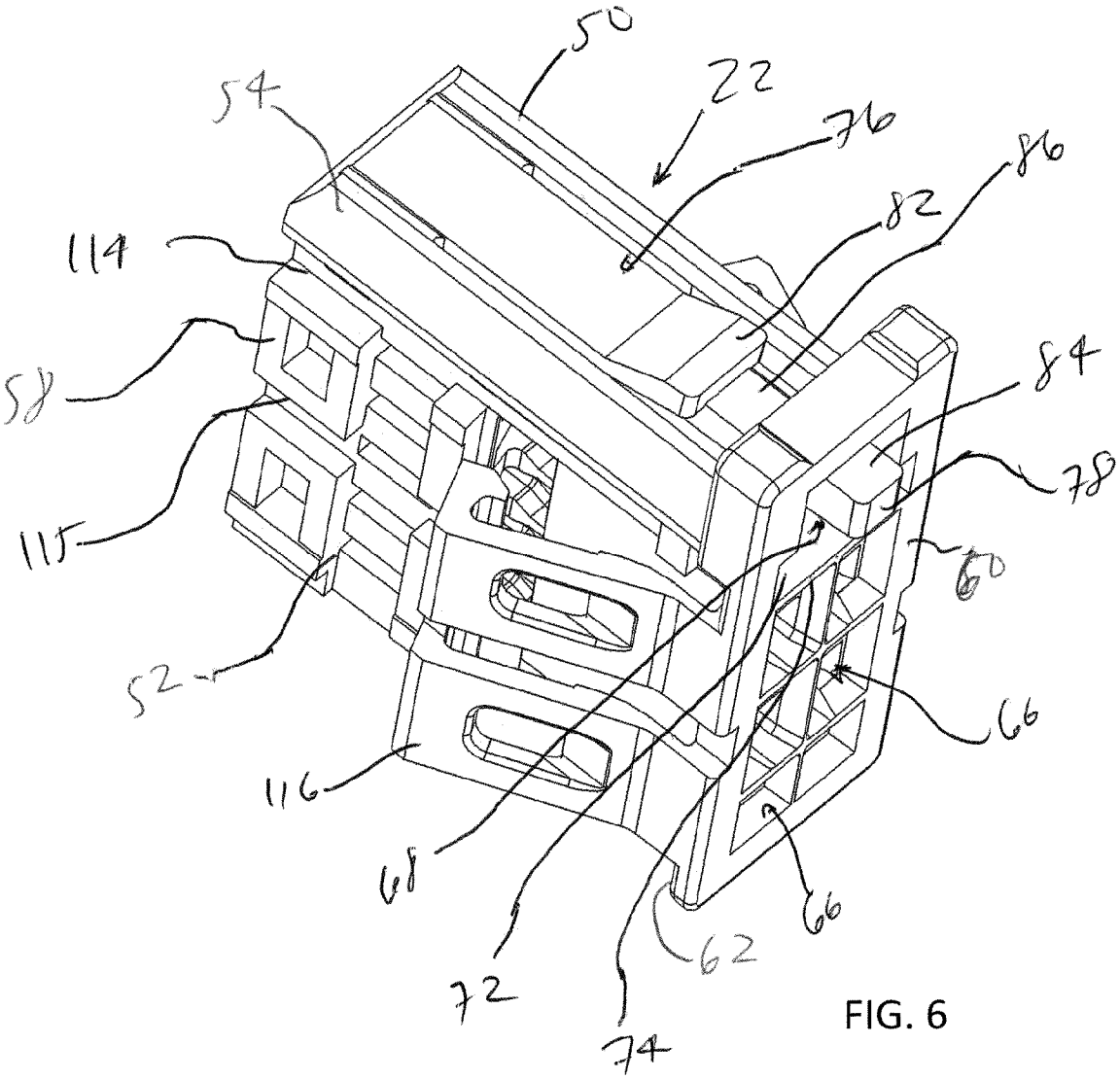
FIG. 6 is a bottom perspective view of a receptacle of the connector system, viewed from a rear end thereof.
Figure 7:
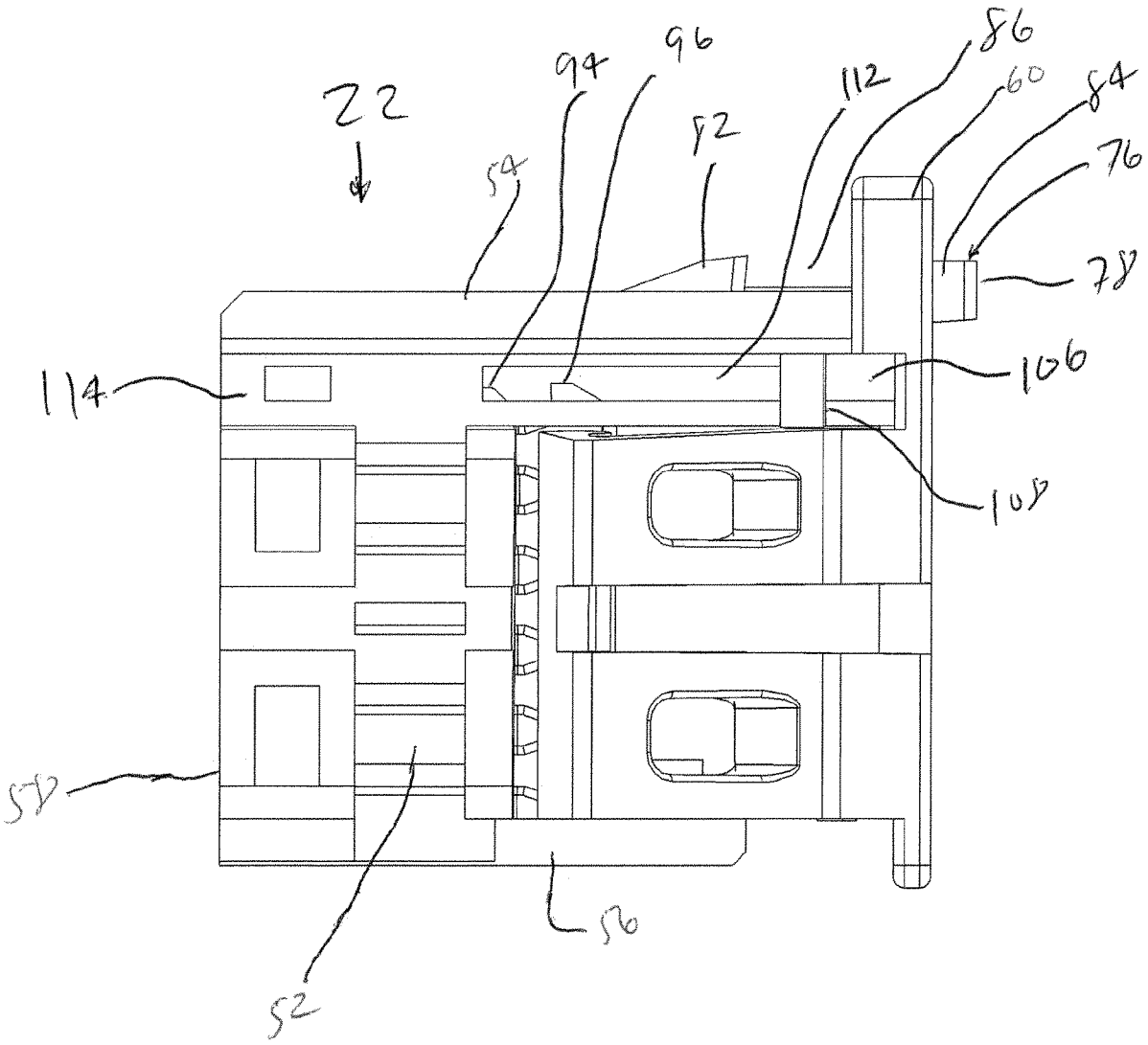
FIG. 7 is a bottom plan view of the receptacle.
Figure 8:
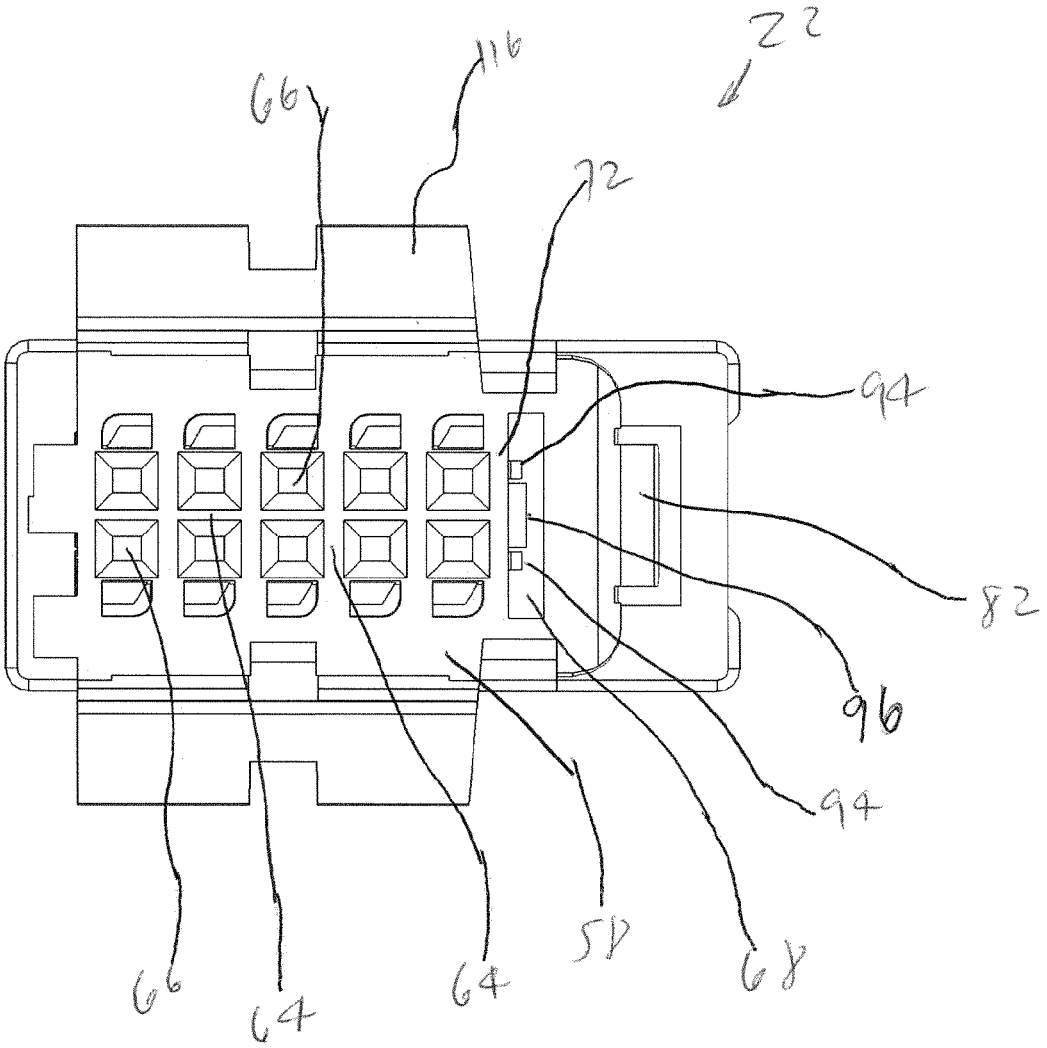
FIG. 8 is a front elevation view of the receptacle.
Figure 9:
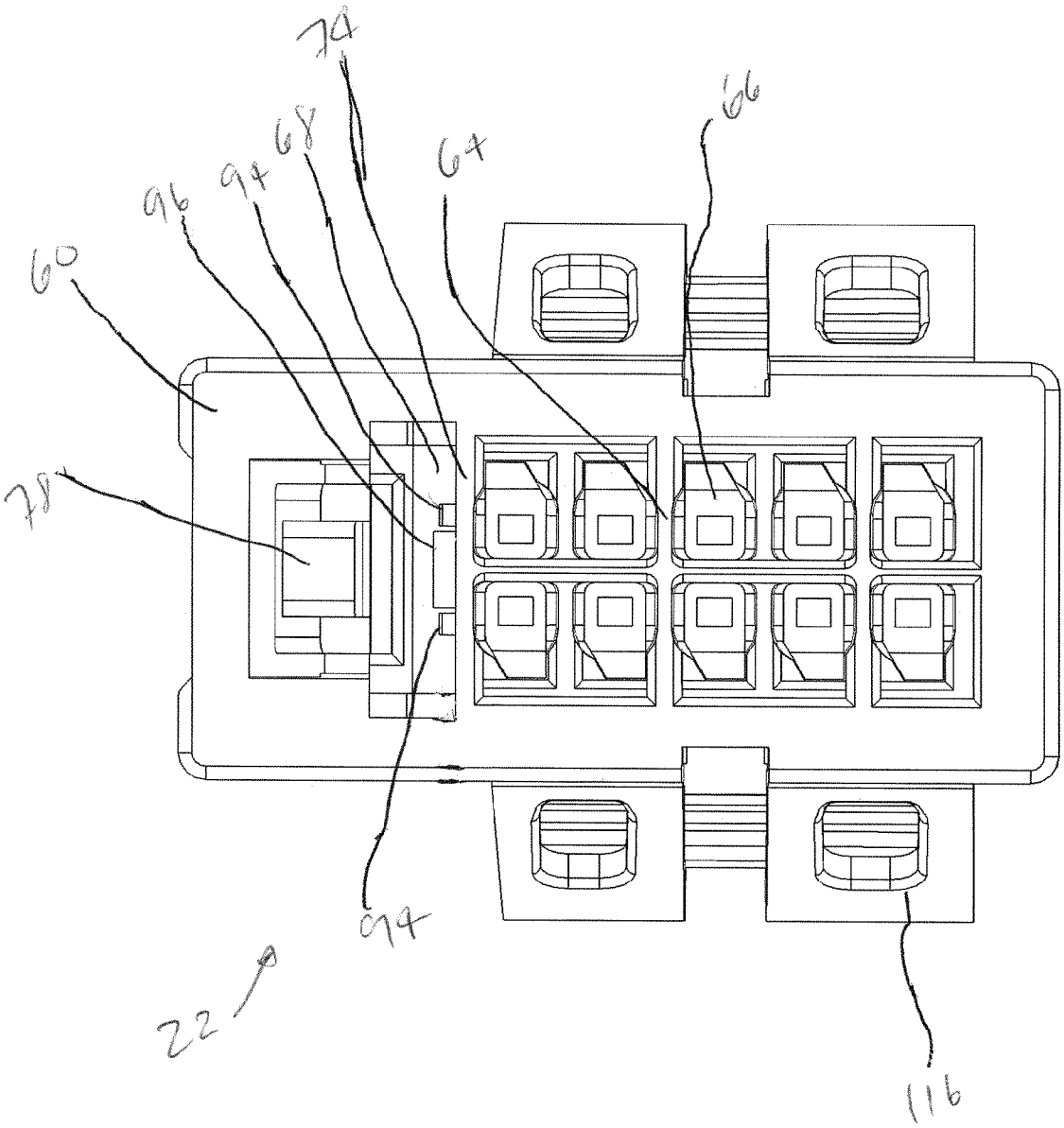
FIG. 9 is a rear elevation view of the receptacle.
Figure 10:
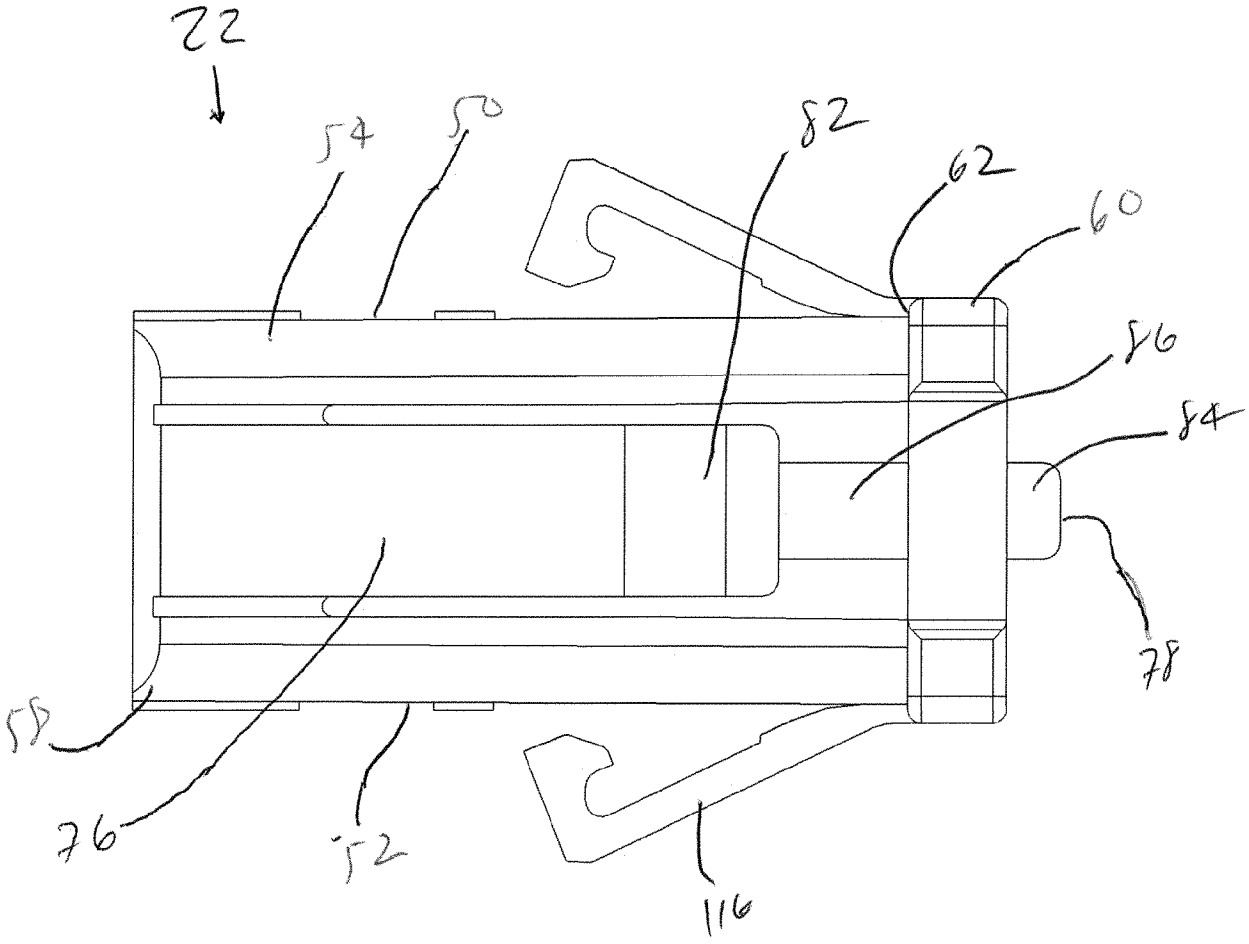
FIG. 10 is a side elevation view of the receptacle.

The header assembly 26 includes an insulative housing 28 having a plurality of electrically conductive terminals or pins 30 mounted therein. The housing 28 may be a plastic material. As best shown in FIGS. 4 and 5, the housing 28 includes a top wall 32, a bottom wall 34, a first side wall 36 connecting the top and bottom walls 32, 34 at first side edges thereof, a second side wall 38 connecting the top and bottom walls 32, 34 at second, opposite side edges thereof, and a front wall 40 connecting the walls 32, 34, 36, 38 together at front ends thereof. The walls 32, 34, 36, 38, 40 form an open-ended cavity 42 which extends from an open rear end 44. A ramped finger receiving opening 46 is formed in the side wall 36 at a position which is proximate to, but spaced from, the rear end 44, thereby defining a section 36*a* of the side wall 36 between the ramped finger receiving opening 46 and the rear end 44. The ramped finger receiving opening 46 is in communication with the cavity 42. Longitudinally extending ribs 48 extend from the top and bottom walls 32, 34 and into the cavity 42. The ribs 48 may commence at the front wall 40 and may extend to the open rear end 44, or may be spaced from the open rear end 44. Additional longitudinally extending ribs 49 may also extend from the top and bottom walls 32, 34 and from the side wall 38 and into the cavity 42. The pins 30 extend through the front wall 40 and into the cavity 42.

As best shown in FIGS. 6-10, the receptacle 22 is formed of an insulative material and includes a top wall 50, a bottom wall 52, a first side wall 54 connecting the top and bottom walls 50, 52 at first side edges thereof, a second side wall 56 connecting the top and bottom walls 50, 52 at second, opposite side edges thereof, a front wall 58 connecting the walls 50, 52, 54, 56 together at front ends thereof, and a rear wall 60 connecting the walls 50, 52, 54, 56 together at rear ends thereof. The receptacle 22 may be formed of a plastic material. The rear wall 60 extends outwardly from the walls 50, 52, 54, 56 such that a shoulder 62 is formed between the rear wall 60 and the walls 50, 52, 54, 56. A plurality of walls 64 forming pin receiving passageways 66 extend from the front wall 58 to the rear wall 60. The pin receiving passageways 66 align with the pins 30 so that the portions of the pins 30 seat within the pin receiving passageways 66 as described herein.

A connector position assurance device slot 68 extends from the front wall 58 to the rear wall 60 and defines a centerline 70 therebetween. The connector position assurance device slot 68 receives the connector position assurance device 24 through an open rear end 72 of the connector position assurance device slot 68 as described herein. The connector position assurance device slot 68 is formed by the side wall 54, an internal dividing wall 74 which separates the connector position assurance device slot 68 from the pin receiving passageways 66, and a portion of the top and bottom wall 50, 52.

Figure 11:
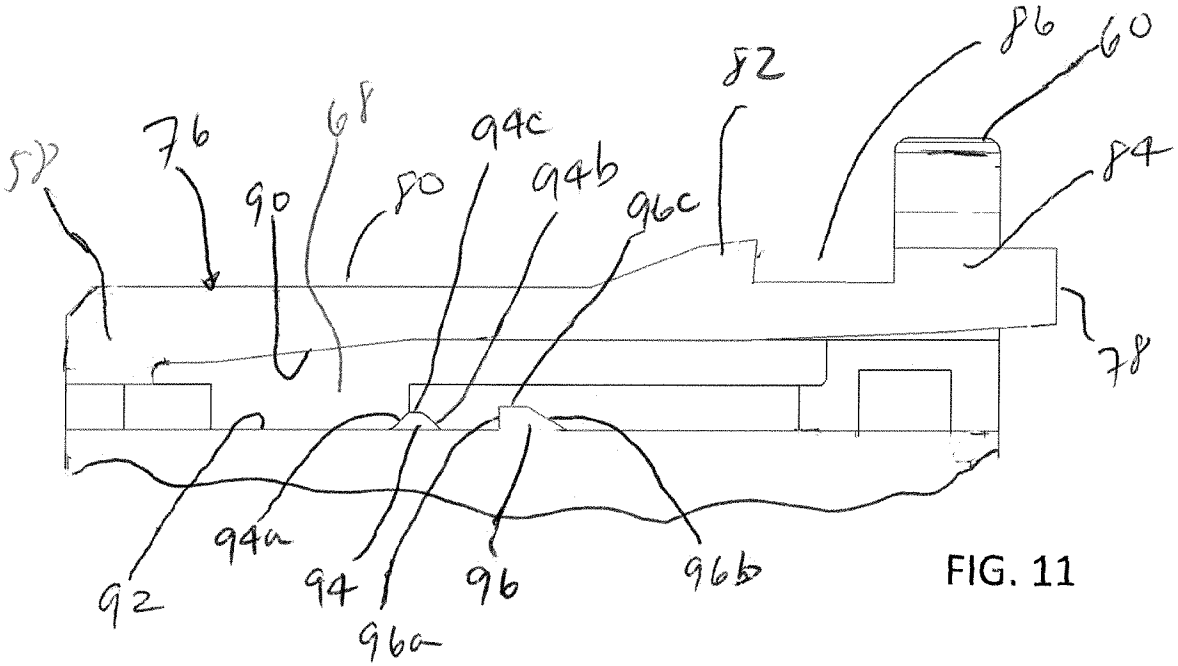
FIG. 11 is a partial cross-sectional view of the receptacle.

A depressible locking latch 76 extends from the front wall 58 and into the connector position assurance device slot 68. As shown, the depressible locking latch 76 is formed as a portion of the side wall 54. The locking latch 76 extends rearwardly past the rear wall 60 to an end surface 78 at a free end. As best shown in FIG. 11, an outer surface 80 of the locking latch 76 is planar with the exception of a ramped finger engaging section 82 and a raised section 84 at the end of the locking latch 76. The sections 82, 84, and the planar section of the surface 80 form a pocket 86. The pocket 86 is sized to accept the section 36*a* of the first side wall 36 of the housing 28 as described herein. An inner surface 90 of the locking latch 76 faces the dividing wall 74.

In an embodiment, the side wall 54 and the depressible locking latch 76 are completely separated from each other and the side wall 54 has a gap through which the ramped finger engaging section 82 extends so that the ramped finger engaging section 82 can engage with the first side wall 36 as described herein.

A surface 92 of the dividing wall 74 which faces the surface 90 of the locking latch 76 is planar, with the exception of ramped nubs 94 and a ramped protrusion 96 which extend from the dividing wall 74 and into the connector position assurance device slot 68. As shown in the example embodiment, the nubs 94 are spaced apart from each other. The nubs 94 are forward of a front end of the ramped finger engaging section 82. Each nub 94 has forward and rearward surfaces 94*a*, 94*b* which angle toward each other and are joined by an intermediate surface 94*c* which is parallel to the planar surface 92. The ramped protrusion 96 is rearward of the nubs 94 and forward of the front end of the ramped finger engaging section 82. The ramped protrusion 96 has a front surface 96*a* which is perpendicular to the planar surface 92 of the dividing wall 74, a rear surface 96*b* which angles from the rear wall 60 toward the front wall 58, and an intermediate surface 96*c* connecting the front and rear surfaces 96*a*, 96*b*. The intermediate surface 96*c* is planar and parallel to the surface 92. In an embodiment, the spaced apart nubs 94 are replaced by a single elongated nub.

Figure 12:
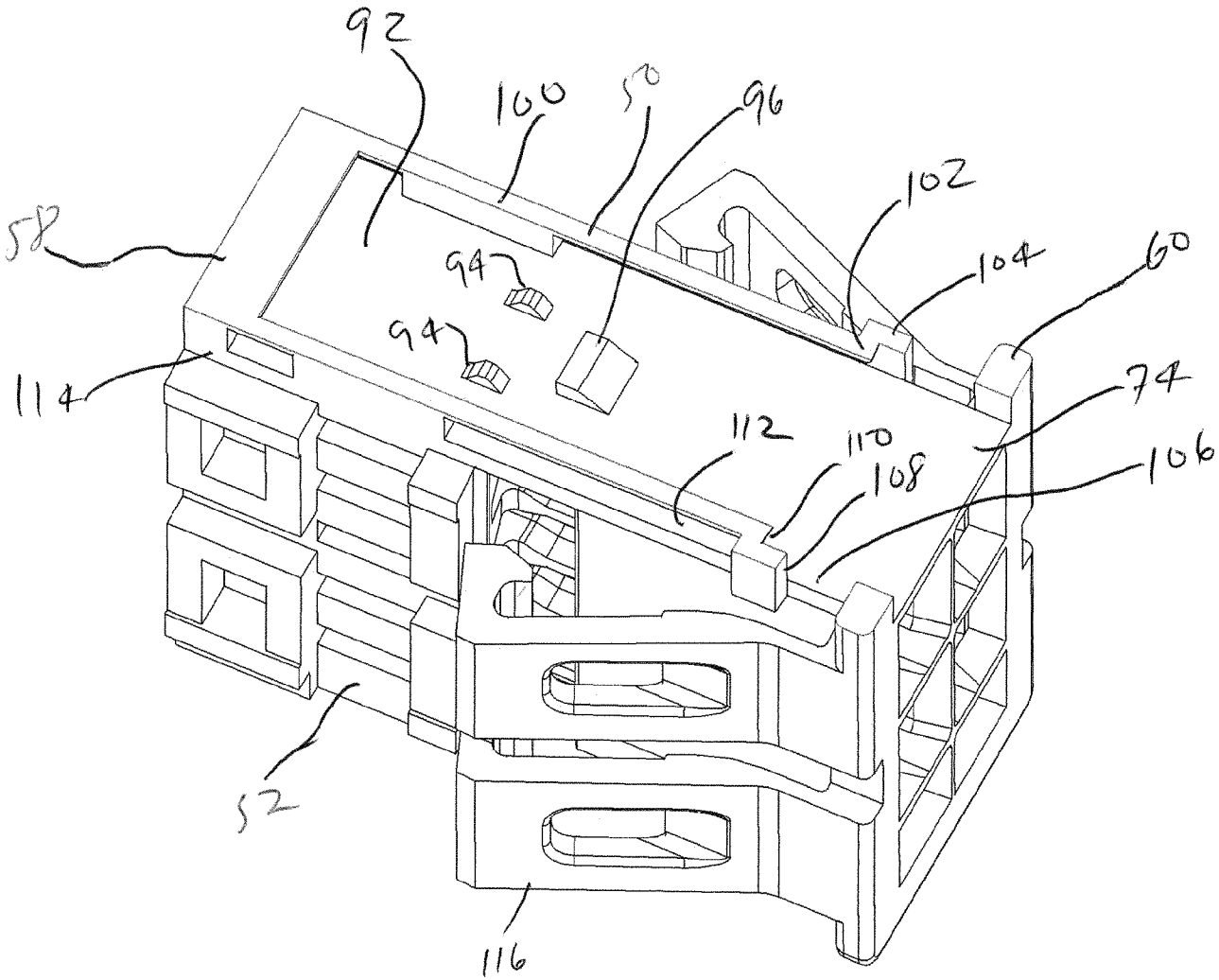
FIG. 12 is a cross-sectional view of the receptacle shown in perspective, and viewed from a rear end thereof.
Figure 13:
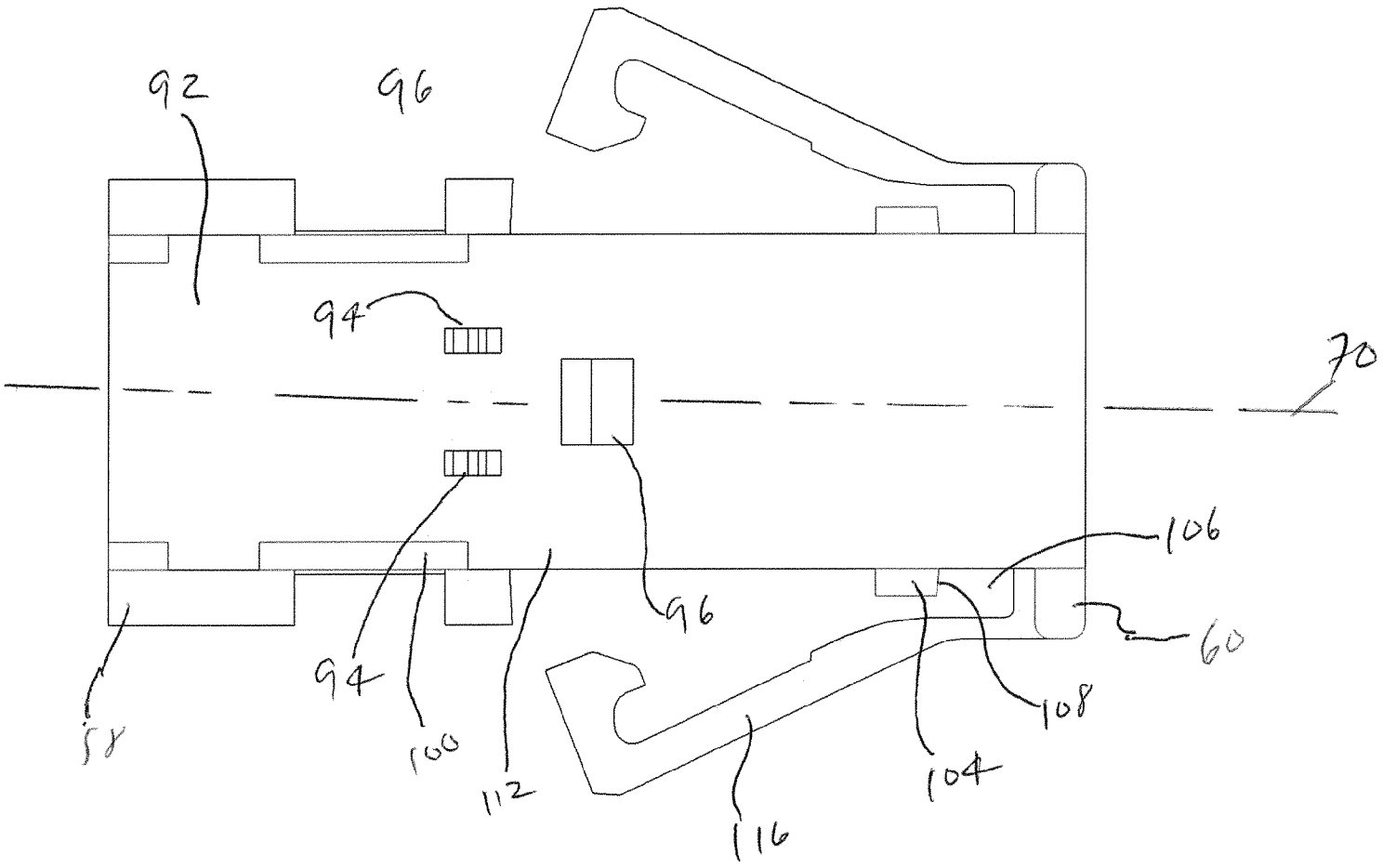
FIG. 13 is the cross-sectional view of the receptacle of FIG. 12 shown as a plan view.

As best shown in FIGS. 12 and 13, the portion of each top and bottom wall 50, 52 which forms a wall of the connector position assurance device slot 68 has a first wall portion 100 which extends longitudinally from the front wall 58, a second wall portion 102 which is perpendicular to the first wall portion 100 and extends outwardly from the centerline 70, and a third portion 104 which extends longitudinally from the outer end of the second wall portion 102 toward the rear wall 60. A space 106 is formed between the third portion 104 and the rear wall 60. The space 106 may be formed by a window or a recess. The front end of the space 106 forms a blocking surface receiving surface 108 which is perpendicular to the planar surface 92. The rear surface of the second wall portion 102 forms a blocking surface receiving surface 110 which is perpendicular to the planar surface 92 and parallel to the blocking surface receiving surface 108. An inner end of the blocking surface receiving surface 110 is inward of the edges which forms the open rear end 72 of the connector position assurance device slot 68. An elongated fin receiving window 112 extends longitudinally along the first wall portion 100 proximate to the second wall portion 102.

The top and bottom wall 50, 52 have channels 114 therein into which the ribs 48 on the housing 28 of the header assembly 26 seat when the receptacle 22 is inserted into the housing 28.

The walls 50, 52, 56 have keyways 115 therein into which the ribs 49 on the housing 28 of the header assembly 26 seat when the receptacle 22 is inserted into the housing 28. The engagement of the ribs 49 within the keyways 115 ensures proper alignment of the receptacle 22 with the housing 28. The top and bottom walls 50, 52 may also have spring arms 116 which extend outwardly therefrom. The spring arms 116 can be flexed toward the top and bottom walls 50, 52 when the receptacle 22 is inserted into the housing 28 and the spring arms 116 engage with inner surfaces of the top and bottom walls 32, 34 of the housing 28 to further connect the receptacle 22 and the housing 28 together.

Figure 14:
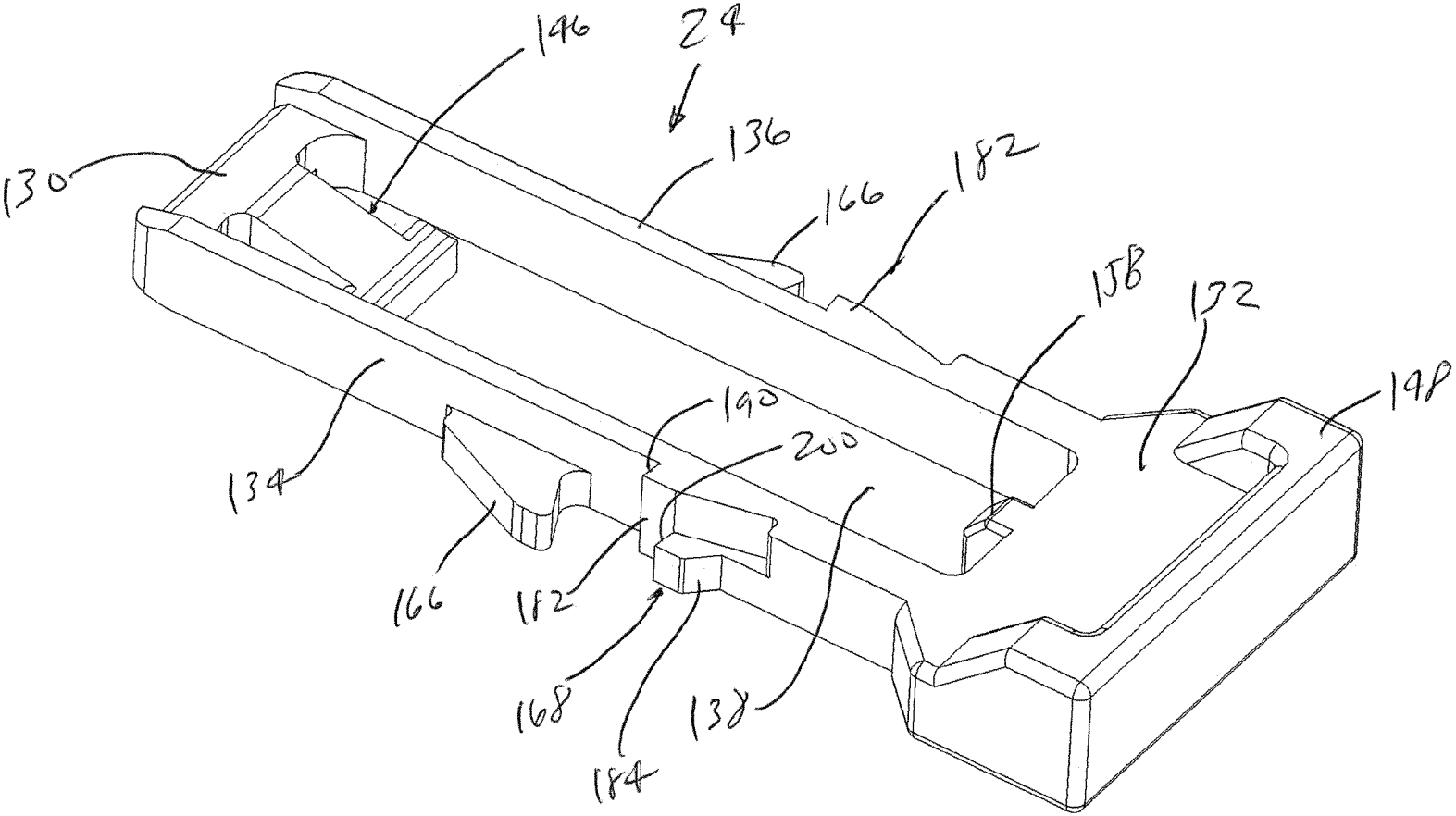
FIG. 14 is a perspective view of an embodiment of a connector position assurance device of the connector system.
Figure 15:
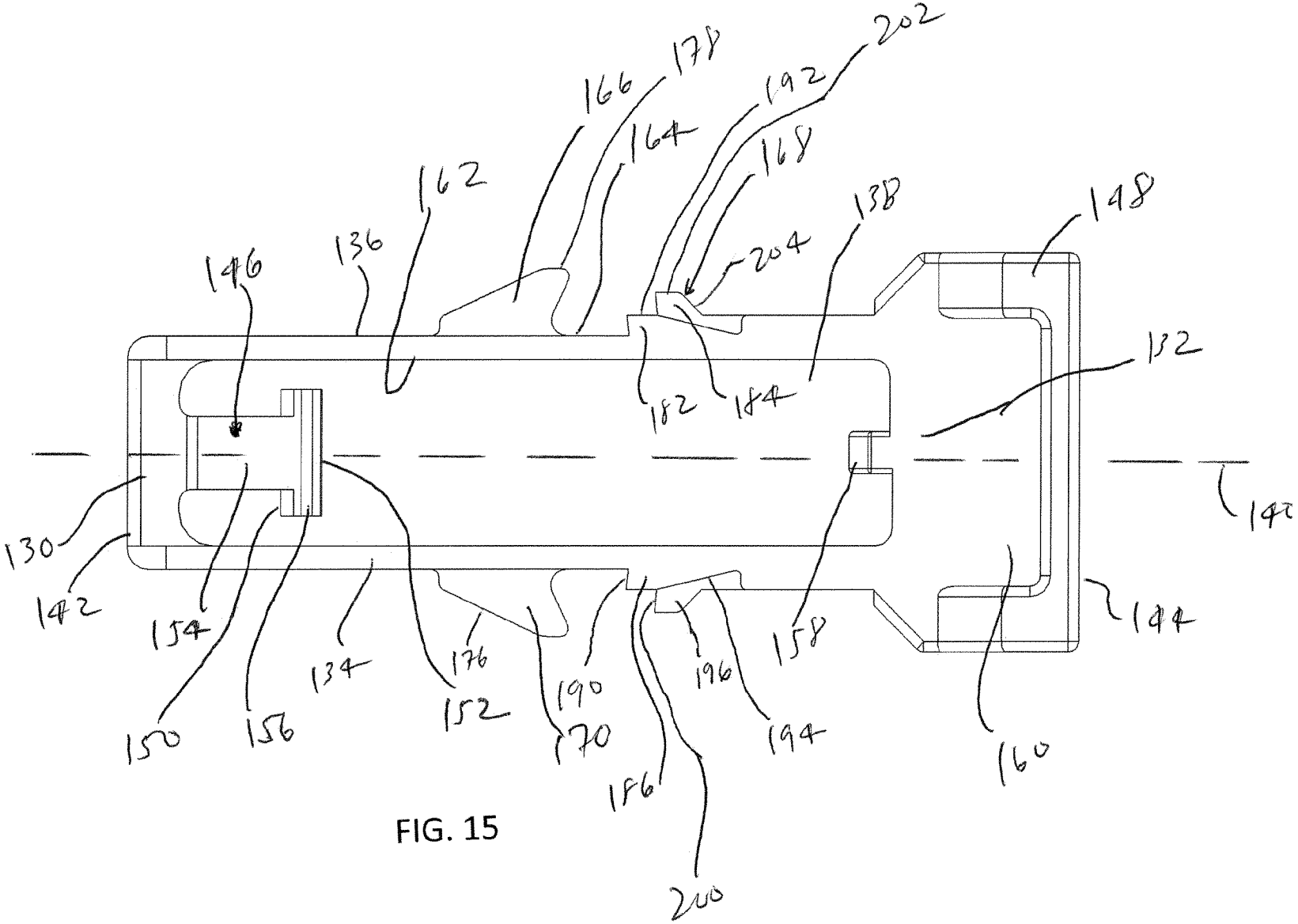
FIG. 15 is a first side elevation view of the connector position assurance device of FIG. 14.
Figure 16:
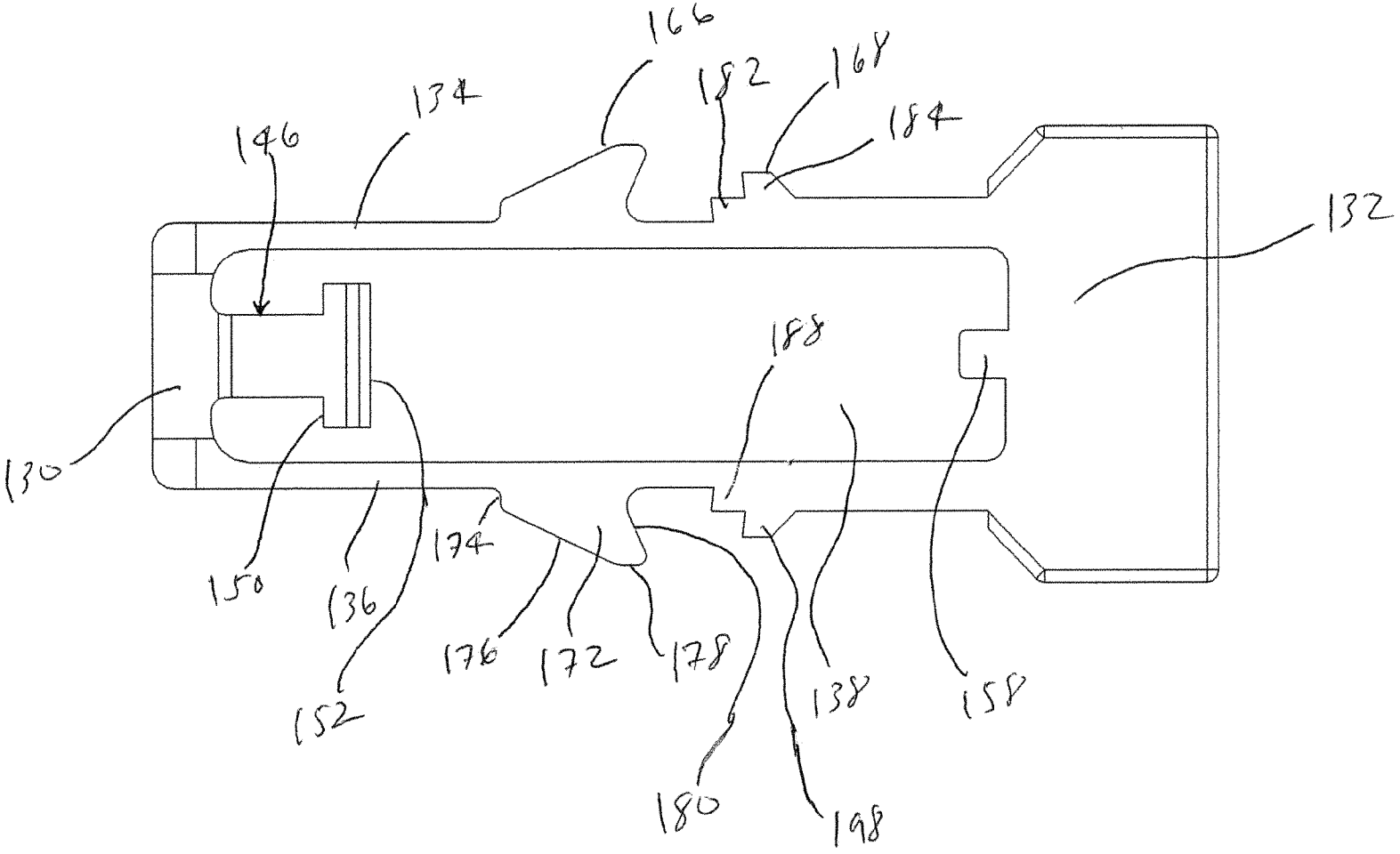
FIG. 16 is a second side elevation view of the connector position assurance device of FIG. 14.

As best shown in FIGS. 14-16, the connector position assurance device 24 has a front connecting portion 130, a rear base portion 132, and a pair of beams or arms 134, 136 which connect the front connecting portion 130 and the rear base portion 132 together. The front connecting portion 130, the rear base portion 132, and the arms 134, 136 define a central opening 138. A centerline 140 extends between front and rear ends 142, 144 of the connector position assurance device 24. The arms 134, 136 extend longitudinally between the front connecting portion 130 and the rear base portion 132. A locking latch or tongue 146 extends longitudinally rearwardly from the front connecting portion 130 and into the central opening 138. A gripping flange 148 extends from the base portion 132. The connector position assurance device 24 may be formed of an insulative material, such as plastic material, or a conductive material, such as metal.

The front connecting portion 130 extends between front ends of the arms 134, 136. First surfaces (which form lower surfaces in use) of the base portion 132 and the arms 134, 136 are planar and are in the same plane, and the first surface of the front connecting portion 130 may be spaced from the first surfaces of base portion 132 and the arms 134, 136. Second surfaces (which form upper surfaces in use) of the base portion 132 and the arms 134, 136 are planar and are in the same plane, and the second surface of the front connecting portion 130 may be spaced from the second surfaces of the base portion 132 and the arms 134, 136.

The locking tongue 146 angles from the front connecting portion 130 to a free end which has a forward surface 150 and a rearward surface 152 which are parallel to each other and perpendicular to the centerline 140. In an embodiment, the locking tongue 146 is generally T-shaped, and has a first portion 154 which extends longitudinally rearward from the front connecting portion 130, and a second wider portion 156 which is perpendicular to the first portion 154 and which defines the surfaces 150, 152.

The base portion 132 extends between rear ends of the arms 134, 136. Side surfaces of the base portion 132 extend outwardly from the arms 134, 136 such that the base portion 132 provides an enlarged end of the connector position assurance device 24. A restricting tongue 158 extends from a front surface of the base portion 132 and into the central opening 138. The gripping flange 148 extends from the base portion 132 and forms a pocket 160 with the base portion 132.

Each arm 134, 136 has a planar inner side surface 162 which forms the central opening 138. Each arm 134, 136 has an outer side surface which has a front portion 164 that extends from the front end 142 and which is planar with the exception of an actuating portion or fin 166 that extends outwardly therefrom, and a blocking protrusion 168 which extends from the front portion 164 to the base portion 132. The blocking protrusion 168 on each arm 134, 136 is rearward of the fin 166.

Each fin 166 is spaced from the connecting portion and is rearward of the locking tongue. The fin 166 on arm 136 is described with the understanding that the fin 166 on arm 134 is identically formed. The fin 166 has a planar first surface 170 (which forms a lower surface in use) which is spaced from the first surface of the arm 134, and a planar second surface 172 (which forms an upper surface in use) which is in the same plane as the second surface of the arm 134 such that the fin 166 has a height which is less than the height of the arm 134. The fin 166 has a first, forward surface 174 which is generally perpendicular to the planar front portion 164, a second angled surface 176 which angles outwardly and rearwardly from the first surface 174 to a third surface 178 which is parallel to the front portion 164, and a fourth, rear, curved surface 180 which extends from the third surface to the side surface. The third surface forms a tip of the fin 166. In an embodiment, the fin 166 generally resembles a shark fin when viewed from above or below the connector position assurance device 24.

Each blocking protrusion 168 is spaced rearwardly from the respective fin 166 and forwardly of the base portion 132. The blocking protrusion 168 on arm 134 is described with the understanding that the blocking protrusion 168 on arm 136 is identically formed. The blocking protrusion 168 has first and second blocking portions 182, 184 which extend outwardly from the centerline 140 and are perpendicular to the planar front portion 164.

The first blocking portion 182 is rearward of the fin 166 and has a first surface 186 (which forms a lower surface in use) which is planar with the first surface of the arm 134 and a second surface 188 (which forms an upper surface in use) which is planar with the second surface of the arm 134. As such, the first blocking portion 182 has the same height as the arm 134. The first blocking portion 182 has a front blocking surface 190 which is perpendicular to the planar front portion 164, a second, outer surface 192 extending from an outer end of the front blocking surface 190 and which is perpendicular to the front blocking surface 190 and parallel to the planar front portion 164, and an angled rear surface 194 extending from a rear end of the second surface 192 and which forms a ramp. The angled surface 194 extends inwardly toward the centerline 140.

The second blocking portion 184 is rearward of the fin 166 and has a first surface 196 (which forms a lower surface in use) which is spaced from the first surface of the arm 134 and a second surface 198 (which forms an upper surface in use) which is planar with the second surface of the arm 134. As such, the second blocking portion 184 has the height which is less than the arm 134 and less than the first blocking portion 182. The second blocking portion 184 has a front blocking surface 200 which is perpendicular to the planar front portion 164, a second, outer surface 202 extending from an outer end of the front blocking surface 200 and which is perpendicular to the front blocking surface 200 and parallel to the planar front portion 164, and an angled rear surface 204 extending from a rear end of the second surface 202 and which forms a ramp. The angled rear surface 204 extends inwardly toward the centerline 140.

The surfaces 190, 192, 194 of the first blocking portion 182 are inward of the surfaces 200, 202, 204 of the second blocking portion 184. The front blocking surface 190 of the first blocking portion 182 is forward of the front blocking surface 200 of the second blocking portion 184. The second outer surface 202 of the second blocking portion 184 is inward of the third surface 178 of the fin 166.

The multiple blocking surfaces 190, 200 on each arm 134, 136 provides for increased blocking surface area.

Figure 17:
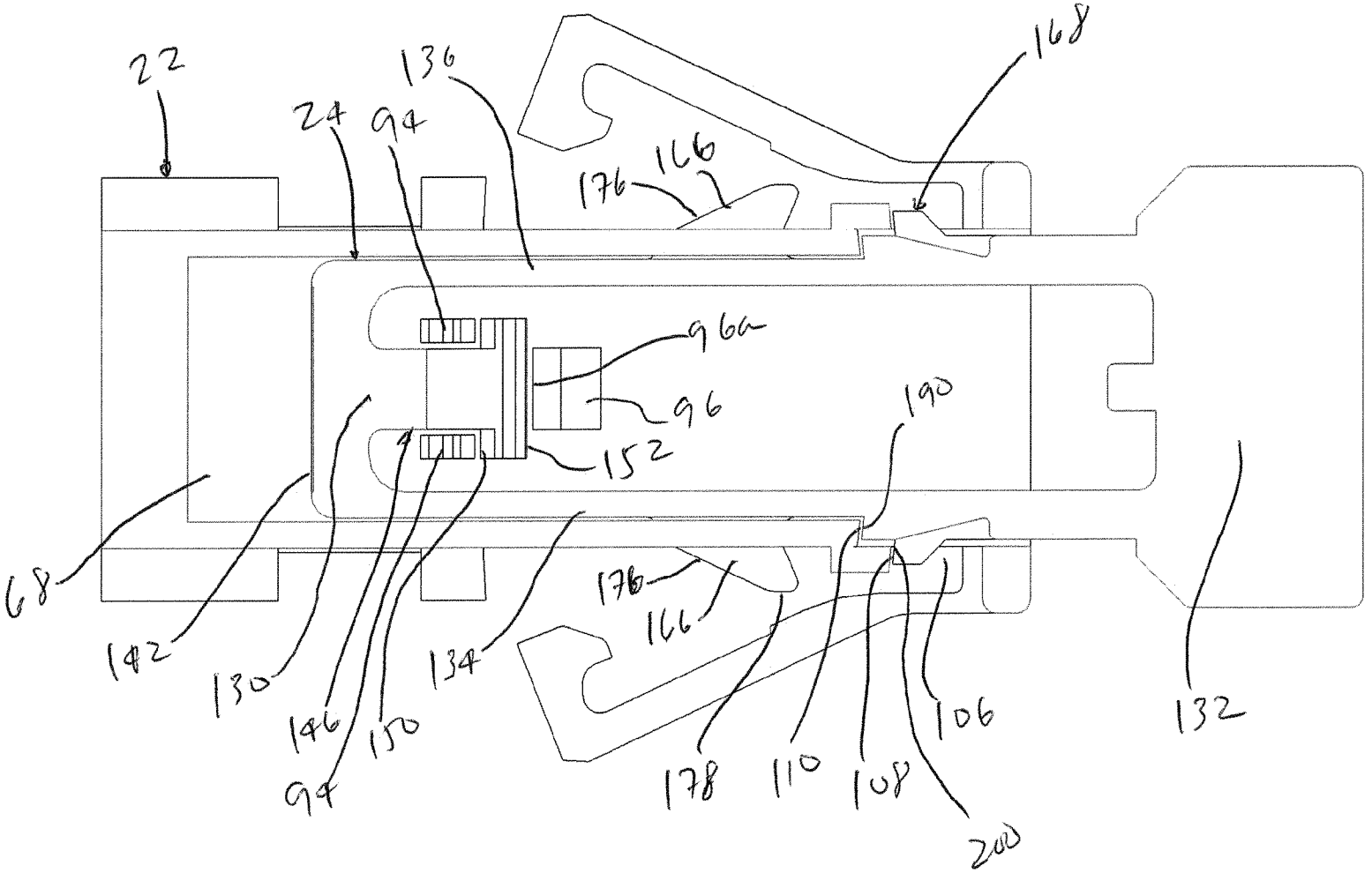
FIG. 17 is a cross-sectional view like that of FIG. 14, but also showing the connector position assurance device of FIG. 14 from a first side elevation view.
Figure 18:
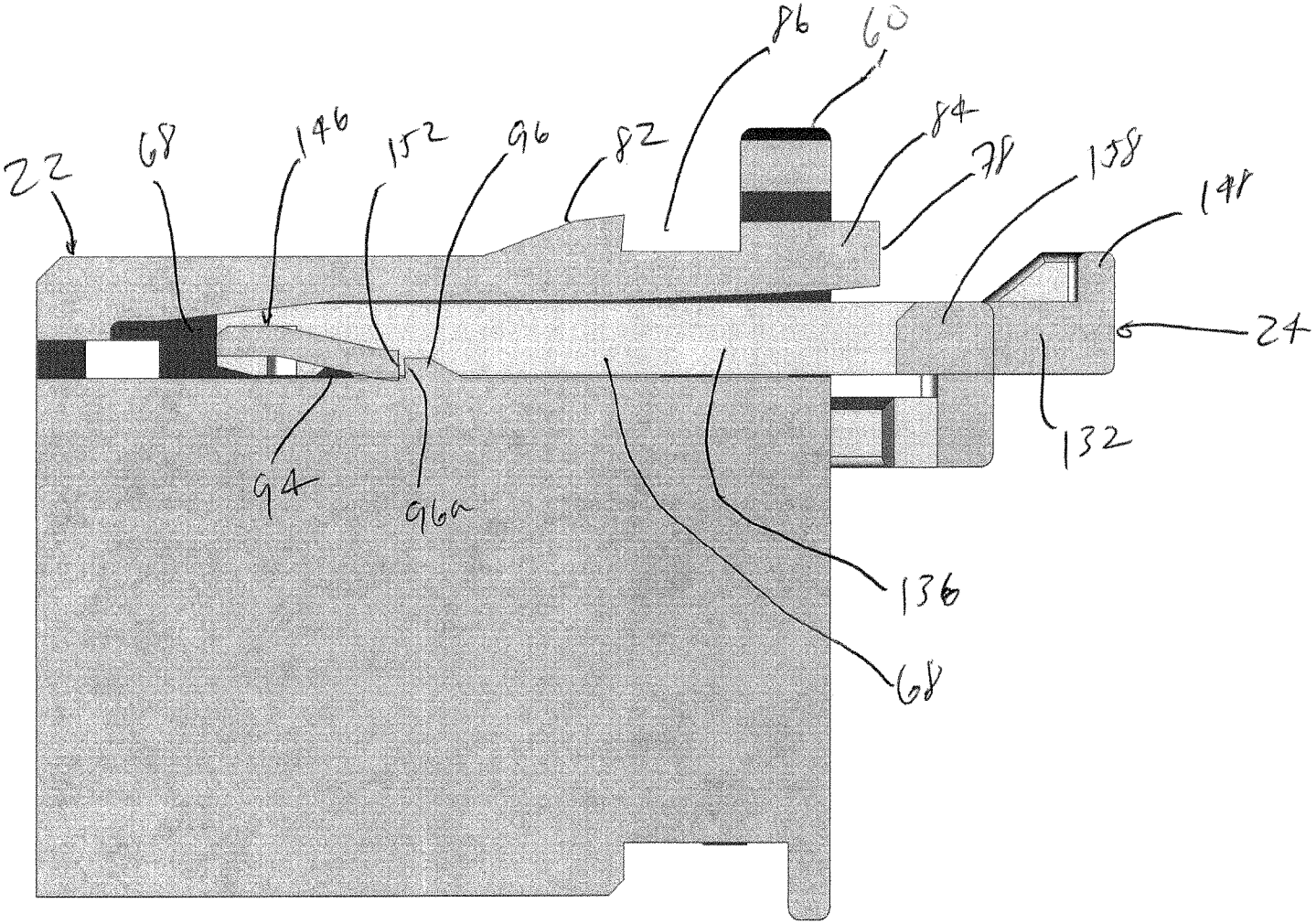
FIG. 18 is a cross-sectional view of the receptacle and connector position assurance device of FIG. 14 shown assembled together in an initial, pre-locked position.
Figure 19:
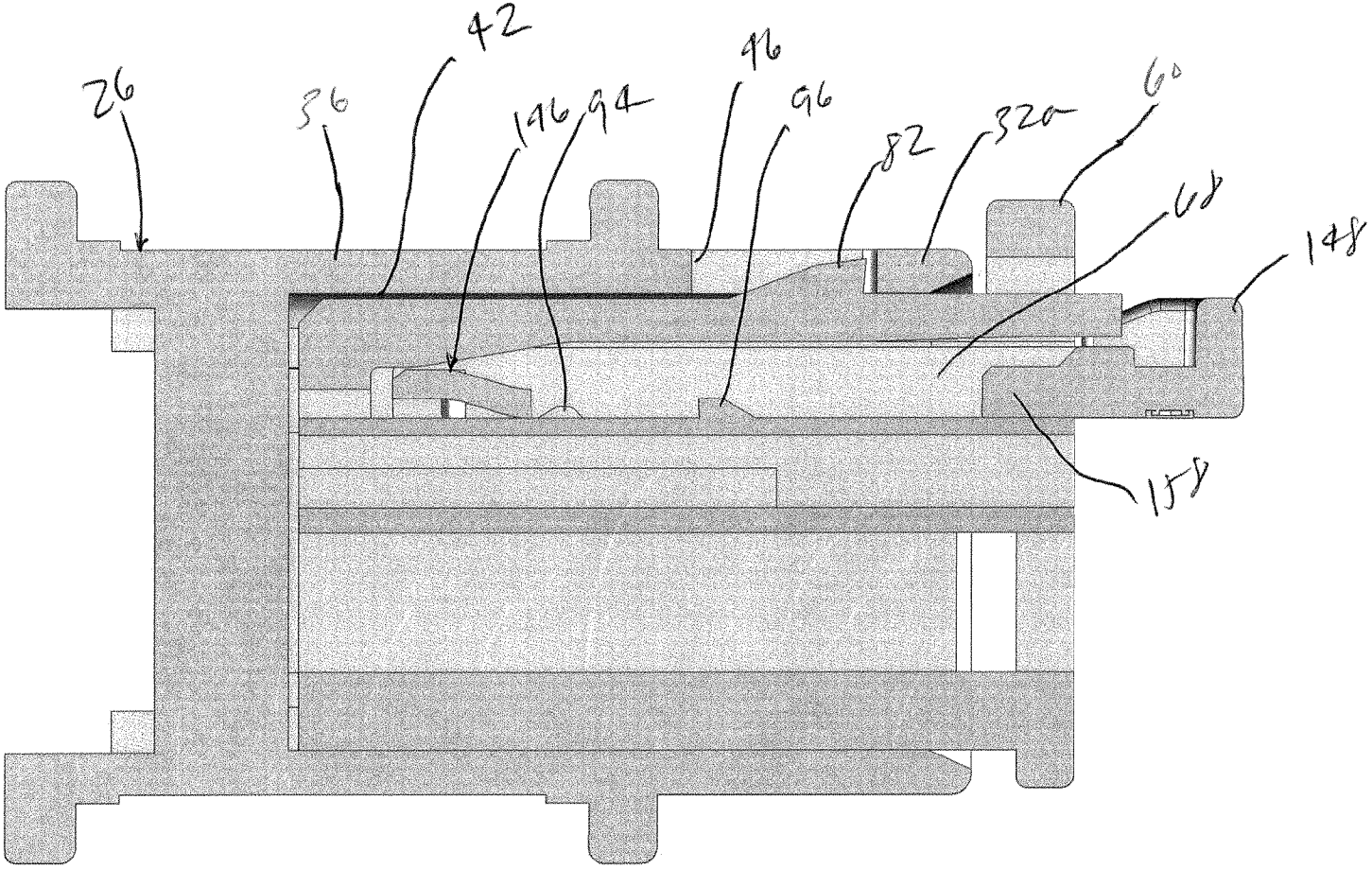
FIG. 19 is a cross-sectional view of the receptacle and connector position assurance device of FIG. 14 shown assembled together in a final locked position.
Figure 20:
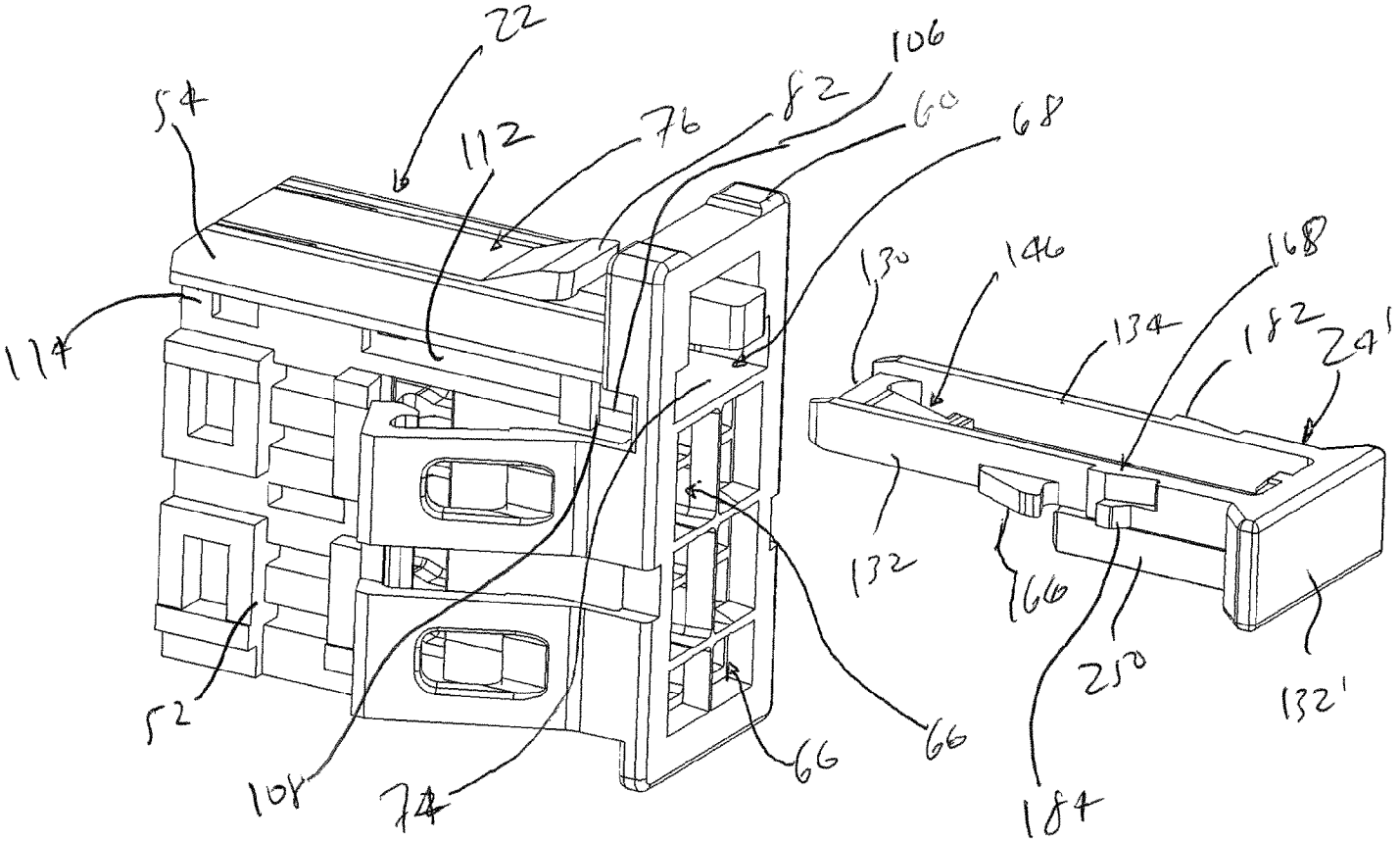
FIG. 20 is a bottom perspective view of a connector system which incorporates the features of a second embodiment of connector position assurance device of the connector system of the present disclosure.
Figure 21:
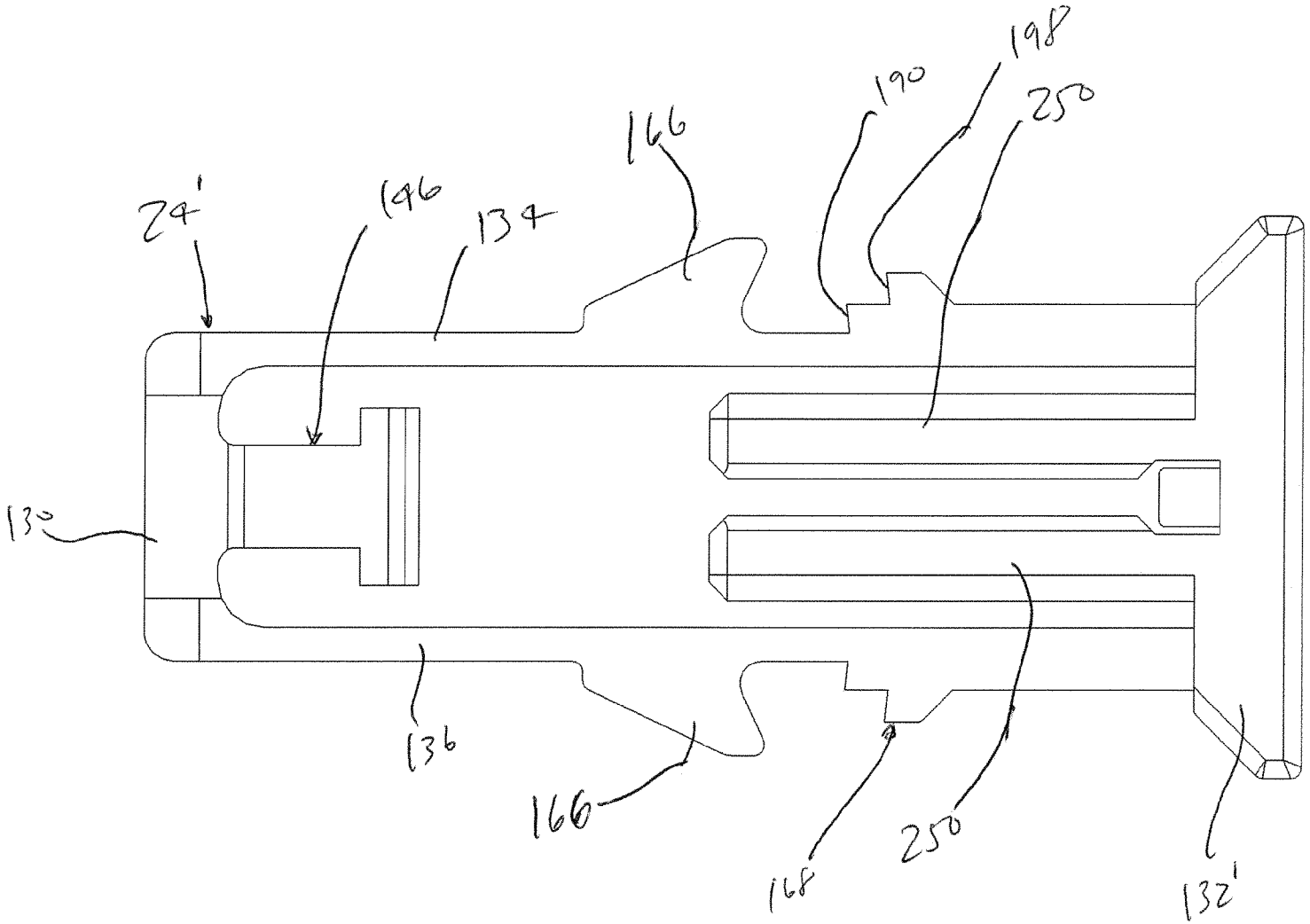
FIG. 21 is a side elevation view of the connector position assurance device shown in FIG. 20.
Figure 22:
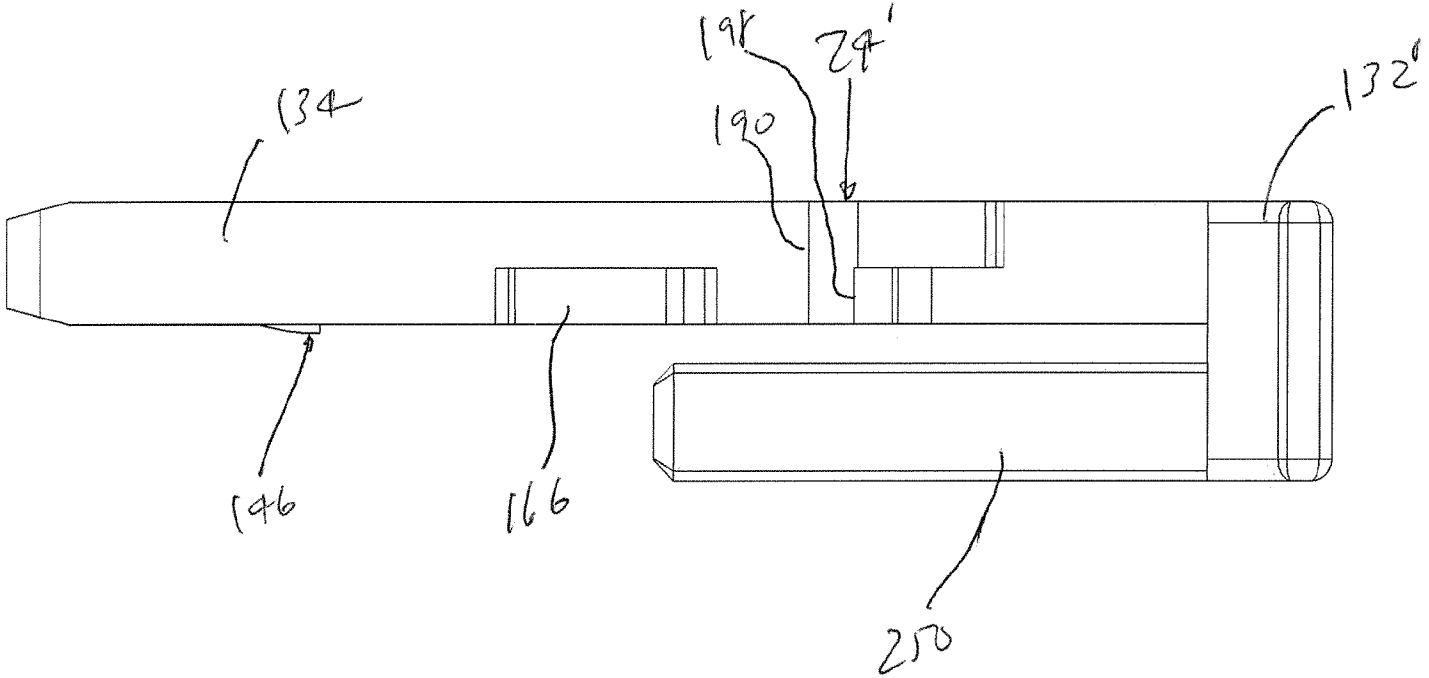
FIG. 22 is a top plan view of the connector position assurance device of FIG. 21.
Figure 23:
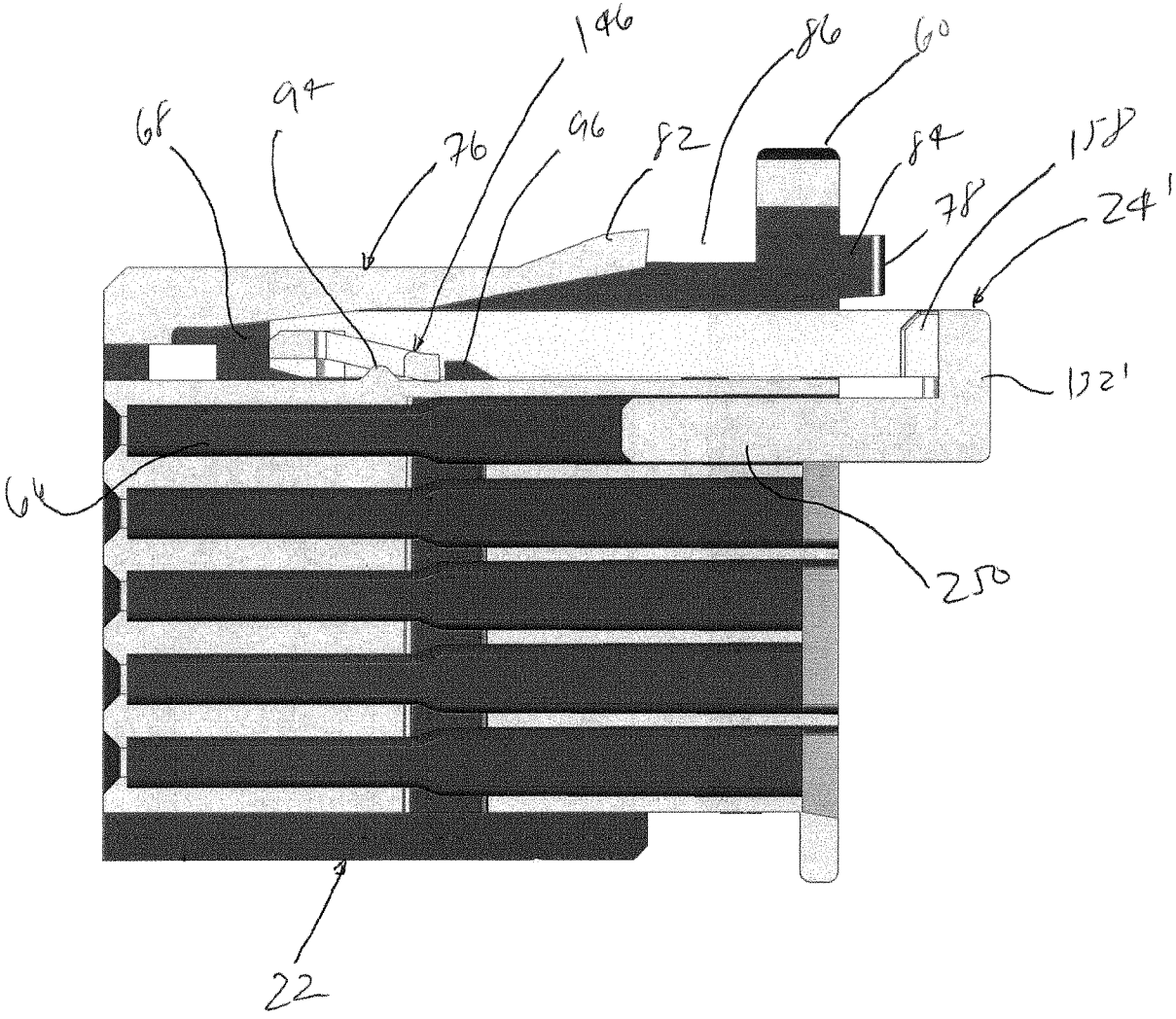
FIG. 23 is a cross-sectional view of the receptacle and connector position assurance device of FIG. 21 shown assembled together in an initial, pre-locked position.

In use, the connector position assurance device 24 is first assembled with the receptacle 22 as shown in FIG. 17. The connector position assurance device 24 is inserted into the connector position assurance device slot 68 by first inserting the front end 142 through the open rear end 72 of the connector position assurance device slot 68. The connector position assurance device slot 68 has width which is slightly larger than the width of the connector position assurance device 24 to ensure a tight fit. As the connector position assurance device 24 is inserted, the arms 134, 136 slide along the portions of the top and bottom walls 50, 52 which form side walls of the connector position assurance device slot 68 until the fins 166 contact the surfaces forming the open rear end 72 of the connector position assurance device slot 68. The second angled surfaces 176 of the fins 166 contact the surfaces forming the open rear end 72, which causes the arms 134, 136 to deflect and bow inwardly toward the centerline 140 and to provide sufficient clearance for the blocking protrusions 168 to enter through the open rear end 72 of the connector position assurance device slot 68. Since the arms 134, 136 are supported on both ends by the front connecting portion 130 and the base portion 132, the connector position assurance device 24 is strong and allows for repeated deflection of the arms 134, 136 without the connector position assurance device 24 breaking or being damaged. By having the arms 134, 136 supported at both ends by the front connecting portion 130 and the base portion 132, instead of being cantilevered as provided for in the prior art, the arms 134 136 are more stable and unlikely to buckle. The connector position assurance device 24 is continued to be pushed into the connector position assurance device slot 68 causing the fins 166 to pass over the blocking surface receiving surfaces 110, and the fins 166 to align with the fin receiving windows, the first blocking portions 182 to align with the blocking surface receiving surfaces 110, and the second blocking portions 184 to align with the spaces 106. The angled rear surfaces 204 may align with the rear edges of the spaces 106. Once the third surfaces 178 of the fins 166 align with the fin receiving windows 112, the arms 134, 136 resume their naturally straight condition and the front blocking surfaces 190 engage against the blocking surface receiving surfaces 110, the second blocking portions 184 move into the spaces 106, and the front blocking surfaces 200 engage against the blocking surface receiving surfaces 108. This places the connector position assurance device 24 and the receptacle 22 into an initial, pre-locked position. The connector position assurance device 24 cannot be further pushed into the connector position assurance device slot 68 since the blocking protrusions 168 prevent the forward longitudinal movement of the connector position assurance device 24 relative to the receptacle 22. As the connector position assurance device 24 is being pushed into the connector position assurance device slot 68, the locking tongue 146 slides along the surface 92 of the dividing wall 74 of the connector position assurance device slot 68. Prior to seating of the blocking protrusions 168, the end of the locking tongue 146 engages the angled rear surface **96*b* of the protrusion 96 and cause the locking tongue 146 to flex. The end of the locking tongue 146 slides over the angled rear surface 96*b* and then seats between the protrusion 96 and the nubs 94 such that the forward surface 150 is proximate to the rearward surfaces 94*b* of the nubs 94 and the rearward surface 152 is proximate to the front surface 96*a* of the protrusion 96. The connector position assurance device 24 cannot be pulled out of the connector position assurance device slot 68 since the engagement of the locking tongue 146 with the front surface 96*a* of the protrusion 96 prevents the rearward longitudinal movement of the connector position assurance device 24 relative to the receptacle 22. The connector position assurance device 24 is now securely held within the receptacle 22 and cannot be readily withdrawn from the receptacle 22. The third surfaces 178 of the fins 166 extend outwardly from the top and bottom walls 50, 52 and a portion of each second angled surface 176 extends outwardly from the top and bottom walls 50, 52**.

The fins 166 are rearward of a forward end of the ramped finger engaging section 82 when the connector position assurance device 24 is assembled with the receptacle 22.

The receptacle 22 and the attached connector position assurance device 24 are now ready to be inserted into the header assembly 26. The receptacle 22 is inserted by inserting the front wall 58 through the open rear end 44 of the cavity 42. The ribs 48 on the housing 28 align with the channels 114 on the receptacle 22 and the ribs 49 on the housing 28 align with the keyways 115 on the receptacle 22 to provide a positive alignment feature. The spring arms 116, if provided, are pushed inward toward the top and bottom walls 50, 52 of the receptacle 22 to allow the receptacle 22 to enter into the housing 28. As the pins 30 encounter and enter into the pin receiving passageways 66.

When the ramped finger engaging section 82 on the depressible locking latch 76 contacts the surfaces forming the open rear end 44 of the cavity 42 at the side wall 36, the locking latch 76 is depressed into the connector position assurance device slot 68 and the end surface 78 engages with the restricting tongue 158 extending from the base portion 132. As the receptacle 22 is further pushed into the housing, the second angled surfaces 176 on the fins 166 engage with the ends of the ribs 48 on the top and bottom walls 32, 34 and the fins 166 are depressed inwardly which causes the legs 134, 136 to bow inwardly. The end surface 78 engages with the restricting tongue 158 prior to the fins 166 engaging with the ribs 48. The legs 134, 136 bow inwardly far enough to disengage the front blocking surfaces 190 from the blocking surface receiving surfaces 110 and to disengage the front blocking surfaces 200 from the blocking surface receiving surfaces 108, however, the connector position assurance device 24 cannot move relative to the receptacle 22 as a result of the engagement of the locking latch 76 with the restricting tongue 158.

As the receptacle 22 is even further pushed into the housing 28, the ramped finger engaging section 82 of the locking latch 76 slides along the inner surface of the side wall 36 until the ramped finger engaging section 82 enters into the ramped finger receiving opening 46 on the housing 28. The section **36*a* of the side wall 36 of the housing 28 seats within the pocket 86. When the ramped finger engaging section 82 enters into the ramped finger receiving opening 46, the locking latch 76 resumes its original straight position and the end surface 78 of the locking latch 76 disengages from the restricting tongue 158. The end surface 78 and a portion of the locking latch 76 proximate to the end surface 78 remain outward of the open rear end 44. The connector position assurance device 24 is thereafter pushed further into the receptacle 22, and the locking tongue 146 flexes and passes over the nubs 94. When the locking tongue 146 passes over the nubs 94, this provides the operator with a tactile feel that the connector position assurance device 24** is fully seated and thereby providing an indication to the operator that the receptacle 22 is fully seated within the header assembly 26 to form the connector system 20 and to place the assembly into the final, locked position. Once the locking tongue 146 is forward of the nubs 94, the locking tongue 146 resumes its unflexed position and engages the forward surface 94*a* of the nubs 94. The fins 166 move forwardly within the elongated fin receiving windows 112 but the arms 134, 136 remain bowed. This holds the connector position assurance device 24 within the receptacle 22.

To remove receptacle 22 from the housing 28, the operator grasps the gripping flange 148 on the base portion 132 of the connector position assurance device 24 and pulls outwardly relative to the receptacle 22. The fins 166 move rearwardly in the receptacle 22 until the fourth, rear, curved surface 180 engage with the front ends of the fin receiving windows 112. The first blocking portions 182 align with the blocking surface receiving surfaces 110 and the second blocking portions 184 align with the spaces 106. Once aligned, the arms 134, 136 straighten and the blocking protrusions 168 reengage with the blocking surface receiving surfaces 108, 110. As the operator pulls the connector position assurance device 24 outwardly relative to the receptacle 22, the locking tongue 146 passes over the nubs 94 and reseats within the space between the nubs 94 and the protrusion 96, thereby providing a tactile feel for the operator to indicate that the connector position assurance device 24 has retracted to its pre-locked position. To complete the removal of the receptacle 22 from the housing 28, the operator pushes on the portion of the locking latch 76 proximate to the end surface 78 to depress the locking latch 76 and move the ramped finger engaging section 82 out of the ramped finger receiving opening 46. Thereafter, the receptacle 22, and the still attached connector position assurance device 24, are withdrawn from the housing 28.

In some embodiments, the ribs 48 are shortened such that the fins 166 pass over the ribs 48 and the arms 134, 136 are allowed to straighten once the receptacle 22 is fully seated within the header assembly 26. This provides a tactile feel to the operator that the receptacle 22 is fully seated within the header assembly 26. In addition, this may reduce creep in the connector position assurance device 24 if plastic is used.

Since the connector position assurance device 24 is contained completely between the locking latch 76 and the dividing wall 74, the assembly of the receptacle 22 and connector position assurance device 24 provides for a low-profile assembly. In addition, since the blocking surfaces 190, 200 are on the arms 134, 136 and are not provided on a cantilevered beam similar to the locking tongue 146 as is provided for in the prior art, the size of the blocking surfaces 190, 200 are no longer limited by the size of the locking tongue 146, and a hole is no longer required in the locking latch 76 of the receptacle 22. Moreover, the arms 134, 136 are not located directly beneath the locking tongue 146 so the clearance required in the prior art for the locking tongue is not needed with the present embodiment. The arms 134, 136 still move underneath the locking tongue 146 when bowed, but the location of the deflected arms 134, 136 are such that extra space is not required under the locking tongue 146. Since the arms 134, 136 are supported on both ends by the front connecting portion 130 and the base portion 132, the connector position assurance device 24 is strong and allows for repeated deflection of the arms 134, 136 without the connector position assurance device 24 breaking or being damaged. By having the arms 134, 136 supported at both ends by the front connecting portion 130 and the base portion 132, instead of being cantilevered as provided for in the prior art, the arms 134, 136 are more stable and unlikely to buckle.

While the locking latch 76 is shown as having the ramped finger engaging section 82, the raised section 84 and the pocket 86, and the header 26 has the ramped finger receiving opening 46 therein, the ramped finger engaging section 82 may be provided on the header 26 and the locking latch 76 has the ramped finger receiving opening 46 therein. In this embodiment, when the locking latch 76 contacts the ramped finger engaging section 82 on the header 26, the locking latch 76 is depressed into the connector position assurance device slot 68 and the end surface 78 engages with the restricting tongue 158 extending from the base portion 132. As the receptacle 22 is even further pushed into the housing 28, the ramped finger engaging section 82 of the header 26 slides along the locking latch 76 until the ramped finger engaging section 82 enters into the ramped finger receiving opening 46 on the locking latch 76. When the ramped finger engaging section 82 enters into the ramped finger receiving opening 46, the locking latch 76 resumes its original straight position and the end surface 78 of the locking latch 76 disengages from the restricting tongue 158. In this embodiment, to complete the removal of the receptacle 22 from the housing 28, the operator pushes on the portion of the locking latch 76 proximate to the end surface 78 to depress the locking latch 76 and move the ramped finger engaging section 82 out of the ramped finger receiving opening 46. Thereafter, the receptacle 22, and the still attached connector position assurance device 24, are withdrawn from the housing 28.

FIGS. 19-22 shows an alternate embodiment of the connector position assurance device 24' formed of an insulative material. The connector position assurance device 24' is identically formed to the connector position assurance device 24, with the exception that the base portion 132' is has a height which is greater than the base portion 132 such that the base portion 132' extends beyond the second surfaces of the arms 134, 136, and a pair of support legs 250 extend from an end of the enlarged base portion 132'. Like elements are labeled with like reference numerals for clarity. The connector position assurance device 24' may be formed of an insulative material, such as plastic material, or a conductive material, such as metal. The support legs 250 extend parallel to the arms 134, 136 and are spaced apart from each other.

In use, the support legs 250 seat within respective ones of the pin receiving passageways 66 which are directly proximate to the dividing wall 74 forming the connector position assurance device slot 68. The support legs 250 only fill a portion of the pin receiving passageways 66 such that the support legs 250 do not interfere with the insertion of pins 30 into the pin receiving passageways 66. This provides further rigidity to the assembly when the receptacle 22 and connector position assurance device 24 are inserted into the housing 28 of the header assembly 26 to form the connector system 20.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. A connector system, comprising:

a header assembly including a housing having walls defining a cavity, the housing being formed of an insulative material, and a plurality of electrically conductive pins extending into the cavity;

a receptacle including walls defining a plurality of pin receiving passageways, a connector position assurance device receiving slot, blocking protrusion receiving surfaces and fin receiving windows, the walls being formed of an insulative material, and wherein the pin receiving passageways are configured to receive respective ones of the pins of the header assembly; and a connector position assurance device including a base portion, a connecting portion and a pair of arms, each arm having a first end connected to the base portion and a second end connected to the connecting portion such that an opening is defined by the base portion, the connecting portion and the arms, a locking tongue extending from the connecting portion and having a free end thereof provided in the opening, each arm having a blocking protrusion extending therefrom which is configured to engage with one of the blocking protrusion receiving surfaces, each arm having a fin extending therefrom which is configured to engage with one of the fin receiving windows and further configured to engage with predetermined ones of the walls of the header assembly, wherein the connector position assurance device cannot move longitudinally relative to the receptacle when the blocking protrusions are engaged with the blocking protrusion receiving surfaces, wherein the connector position assurance device is assembled with the receptacle and the receptacle is assembled with the housing, the fins engage with the predetermined ones of the walls of the housing.

2. The connector system of claim 1, wherein the receptacle further includes a locking latch extending from one of the walls, and the locking latch is configured to be depressed into the opening and engage with the base portion.

3. The connector system of claim 2, wherein the locking latch forms a wall of the connector position assurance device receiving slot.

4. The connector system of claim 3, wherein the connector position assurance device further includes a restricting tongue extending from the base portion which engages with the locking latch when the locking latch is depressed into the opening.

5. The connector system of claim 3, wherein the connector position assurance device further includes a pair of legs extending from the base portion, the legs seating within predetermined ones of the pin receiving passageways.

6. The connector system of claim 2, wherein the housing further includes an opening into which the locking latch is configured to engage.

7. The connector system of claim 1, wherein the connector position assurance device further includes a pair of legs extending from the base portion, the legs seating within predetermined ones of the pin receiving passageways.

8. The connector system of claim 1, wherein each blocking protrusion has first and second blocking surfaces, each blocking surface engaging with one of the blocking protrusion receiving surfaces.

9. The connector system of claim 8, wherein the first and second blocking surfaces are parallel to each other.

10. The connector system of claim 1, wherein the receptacle further includes a projection extending into the connector position assurance device receiving slot, the locking tongue being configured to engage with the projection.

11. The connector system of claim 10, wherein the receptacle further includes at least one nub extending into the connector position assurance device receiving slot, the at least one nub being spaced from the projection, wherein the locking tongue is seated between the projection and a first side of the at least one nub in a first position, and the locking tongue is seated on a second opposite side of the at least one nub in a second position.

12. The connector system of claim 1, wherein the connector position assurance device is formed of one of plastic and metal.

13. A connector system, comprising:

a header assembly including a housing having walls defining a cavity therein, the housing being formed of an insulative material, and a plurality of electrically conductive pins extending into the cavity;

a receptacle including walls defining a plurality of pin receiving passageways, a connector position assurance device receiving slot, and a fin receiving window, the walls being formed of an insulative material, wherein the pin receiving passageways are configured to receive respective ones of the pins of the header assembly, and a depressible locking latch extending from one of the walls, the receptacle configured to be seated within the cavity; and a connector position assurance device configured to be seated within the connector position assurance device receiving slot, the connector position assurance device including walls defining an opening, a fin extending from one of the walls and which is configured to engage with the fin receiving window, the depressible locking latch being configured to be depressed into the opening of the connector position assurance device, wherein the locking latch is flexed and depressed into the opening of the connector position assurance device and engages with one of the walls of the connector position assurance device in a first position, and wherein the locking latch is unflexed and engages with the walls of the header assembly in a second position to lock the receptacle to the housing, wherein when the connector position assurance device is assembled with the receptacle and the receptacle is assembled with the housing, the fin engages with the housing.

14. The connector system of claim 13, wherein the receptacle further includes a blocking protrusion receiving surface, and the connector position assurance device further includes a blocking protrusion extending from one of the walls, the blocking protrusion being configured to engage with the blocking protrusion receiving surface.

15. The connector system of claim 13, wherein the receptacle further includes multiple blocking protrusion receiving surfaces, and the connector position assurance device further includes multiple blocking protrusions extending from the walls, the blocking protrusions being configured to engage with a respective blocking protrusion receiving surface.

16. The connector system of claim 15, wherein two blocking protrusions are provided on two of the walls and on the blocking protrusions on each wall are parallel to each other.

17. The connector system of claim 13, wherein the connector position assurance device further includes a restricting tongue extending from one of the walls which engages with the locking latch when the locking latch is depressed into the opening of the connector position assurance device.

18. The connector system of claim 13, wherein the connector position assurance device further includes a locking tongue extending from one of the walls; and wherein the receptacle further includes a projection extending into the connector position assurance device receiving slot, the locking tongue being configured to engage with the projection.

19. The connector system of claim 18, wherein the receptacle further includes at least one nub extending into the connector position assurance device receiving slot, the at least one nub being spaced from the projection, wherein the locking tongue is seated between the projection and a first side of the at least one nub in a first position, and the locking tongue is seated on a second opposite side of the at least one numb in a second position.

20. The connector system of claim 13, wherein the connector position assurance device is formed of one of plastic and metal.

* * * * *